US009909796B2

(12) United States Patent
Bucceri

(10) Patent No.: US 9,909,796 B2
(45) Date of Patent: Mar. 6, 2018

(54) SNOW MAKING METHOD AND APPARATUS

(71) Applicant: Alfio Bucceri, New Farm (AU)

(72) Inventor: Alfio Bucceri, New Farm (AU)

( * ) Notice: Subject to any disclaimer, the term of this patent is extended or adjusted under 35 U.S.C. 154(b) by 202 days.

(21) Appl. No.: 14/819,895

(22) Filed: Aug. 6, 2015

(65) Prior Publication Data

US 2016/0040920 A1 Feb. 11, 2016

Related U.S. Application Data

(60) Provisional application No. 62/148,813, filed on Apr. 17, 2015.

(30) Foreign Application Priority Data

| | | |
|---|---|---|
| Aug. 7, 2014 | (AU) | 2014903078 |
| Dec. 23, 2014 | (AU) | 2014905223 |
| Feb. 16, 2015 | (AU) | 2015900501 |
| Apr. 17, 2015 | (AU) | 2015901384 |

(51) Int. Cl.
*F25C 3/04* (2006.01)

(52) U.S. Cl.
CPC ..... *F25C 3/04* (2013.01); *F25C 2303/042* (2013.01)

(58) Field of Classification Search
CPC ..... F25C 3/04; F25C 2303/042; F25C 2303/046; F25C 2303/048–2303/0481; F25C 2303/00; F25C 2303/044; F25C 3/00
USPC ..... 239/2.2, 14.2, 124, 125
See application file for complete search history.

(56) References Cited

U.S. PATENT DOCUMENTS

| | | | | |
|---|---|---|---|---|
| 2,699,045 A * | 1/1955 | Bailey | B01J 8/1836 62/340 |
| 3,733,029 A * | 5/1973 | Eustis | F25C 3/04 239/14.2 |
| 4,742,958 A | 5/1988 | Bucceri | |
| 4,919,331 A * | 4/1990 | Kosik, Sr. | F25C 3/04 239/132.1 |
| 4,973,142 A | 11/1990 | Squire | |
| 5,297,731 A | 3/1994 | Bucceri | |
| 5,400,966 A * | 3/1995 | Weaver | F25C 3/04 239/14.2 |

(Continued)

FOREIGN PATENT DOCUMENTS

WO 2014146009 A2 9/2014

*Primary Examiner* — Arthur O Hall
*Assistant Examiner* — Cody Lieuwen
(74) *Attorney, Agent, or Firm* — Hudak, Shunk & Farine Co., LPA

(57) ABSTRACT

A snow making system, suitable for making man-made snow for ski-runs or ski-slopes, uses a snow making machine, where ice is converted into snow-like particles and directed in an upwardly-directed stream, into which a spray or mist of water droplets is introduced. The snow-like particles operate as nucleating agents for the water droplets to convert the droplets into flakes of snow. The flakes of snow may be introduced into the snow making machine, converted into snow-like particles and be incorporated into the stream to produce further flakes of snow. The flakes of snow can be "recycled" to the snow making machine until the desired quantity of snow has been produced. The system enables snow to be made at ambient air temperatures just above, or below, the freezing point of water.

7 Claims, 27 Drawing Sheets

(56) References Cited

U.S. PATENT DOCUMENTS

| | | | | |
|---|---|---|---|---|
| 5,884,841 | A * | 3/1999 | Ratnik | F25C 3/04 239/14.2 |
| 6,454,182 | B1 | 9/2002 | Bucceri | |
| 6,691,926 | B1 * | 2/2004 | Moen | F25C 3/04 239/14.1 |
| 6,938,830 | B2 | 9/2005 | Bucceri | |
| 6,951,308 | B2 | 10/2005 | Bucceri | |
| 7,484,373 | B2 | 2/2009 | Bucceri | |
| 8,403,242 | B2 | 3/2013 | Bucceri | |
| 2003/0181248 | A1 | 9/2003 | Bucceri | |
| 2005/0035210 | A1 | 2/2005 | Bucceri | |
| 2011/0049258 | A1 * | 3/2011 | Lehner | F25C 3/04 239/2.2 |

* cited by examiner

SNOW MAKING METHOD AND APPARATUS

BACKGROUND OF THE INVENTION

1. Field of the Invention

This invention relates to a snow making system (i.e. method and apparatus) capable of producing high quality snow efficiently and in large quantities.

This system can be used in both above- and below-freezing environments (i.e. above- or below 0° C.) to produce man-made snow.

The term "snow" shall be used to include "artificial snow" or "man-made snow".

2. Prior Art

There has been a long-standing requirement for the economic production of snow at snow fields or ski-resorts where only limited or insufficient natural snow is available e.g. due to lack of moisture in the air, high ambient air temperatures, high ground temperatures, heavy skiing usage or the like.

As natural snow is seasonal, and sufficient natural snow falls cannot be guaranteed (e.g. by the opening of the local skiing season), ski resort operators may only have a limited period each year in which they can recoup the capital- and operating costs of their resorts. In addition, potential investors in such resorts may be deterred from investing if they consider the risk of no-snow/insufficient-snow, is too high.

Over the years, many proposals have been put forward for the production of snow in-situ on the snow fields; and examples of earlier proposals by the present inventor (Bucceri) have been disclosed, inter alia, in U.S. Pat. Nos. 4,742,958; 4,973,142; 5,297,731; 6,454,182; 6,938,830; 6,951,308; 7,484,373; and 8,403, 242; together with US Patent Application Publications US 2003/0181248 A1; & US 2005/0035210 A1. These publications reflect over 20 years research & development in the field of producing snow by the present inventor At temperatures below −5 degrees Celsius (−5° C.), conventional "state-of-the-art" snow making machines, as discussed below, can be operated whereby water particles, ejected out of the water nozzles on the machines, are mixed with a large volume of ambient air and blown into the sky to allow sufficient "hang-time" for the water particles to yield sufficient heat energy to the ambient air to enable the water particles to freeze into ice crystals and snow.

"A modern snow fan usually consists of one or more rings of nozzles which inject water into the fan air stream. A separate nozzle or small group of nozzles is fed with a mix of water and compressed air and produces the nucleation points for the snow crystals. The small droplets of water and the tiny ice crystals are then mixed and propelled out by a powerful fan, after which they further cool through evaporation in the surrounding air as they fall to the ground. The crystals of ice act as seeds to make the water droplets freeze at 0° C. (32° F.). Without these crystals the water would supercool instead of freezing. The ratio of ice to water is typically 12 parts water: 1 part ice seeds produced by an on-board air compressor or an external compressed air source. This method can produce snow when the wet-bulb temperature of the air is as high as −2° C. (28.4° F.). The lower the air temperature is, the more and the better snow a snow cannon can produce. This is one of the main reasons snow cannons are usually operated in the night. The quality of the mixing of the water and air streams and their relative pressures is crucial to the amount of snow made and its quality." (Reference: http://en.wikipedia.org/wiki/Snow-making)

International Publication WO 2014/146009 A2 (Dodson) discloses a Nucleator for Generating Ice Crystals for Seeding Water Droplets in Snow-Making Systems". The nucleator comprises a mixing chamber for compressed air and water, the compressed air and water mixture is fed to a nucleating block which divides and directs the mixture to a plurality of nozzle channels lying in a plane perpendicular to, and separated from, each other by a select number of degrees; and respective nucleator nozzles, each nozzle connected to a respective nozzle channel, and each nozzle initially further pressurizing the mixture along a convergent portion of the nozzle and then depressurizing the mixture in a divergent portion of the nozzle (at the nozzle outlet) so that the mixture exits the nozzle outlet as tiny ice crystals.

While the nucleator can improve the rate of conversion of water droplets to snow crystals, the snow crystals can still only be formed when the ambient temperature is below the freezing point of water.

While the conventional snow making machines can produce snow, the snow is typically of poor quality; and the machines can only operate when the ambient temperature is low enough.

OBJECTS OF THE INVENTION

It is an object of the present invention to provide a snow making system which overcomes, or at least ameliorates, the disadvantages of conventional snow making systems.

Other preferred objects of the present invention will become apparent from the following description.

SUMMARY OF THE PRESENT INVENTION

In a first preferred embodiment, the present invention resides in a method for making snow, including the steps of:

a) forming snow-like particles from ice;
b) blowing at least one stream of the snow-like particles into the ambient air, the ambient air having a temperature just above, or below, the freezing point of water; and
c) directing a spray or mist of water droplets into the stream to form flakes of snow.

Preferably, the snow-like particles acts as nucleating agents for the water droplets to assist in the formation of the snow flakes.

Preferably, the method includes the further step of:

d) adding at least of the portion of the snow flakes formed in step c) to the snow-like particles before step b), the snow flakes also providing nucleating agents for the water droplets.

Preferably, in step d), all of the snow flakes are added to the snow-like particles until the desired quantity of snow has been produced.

Preferably, in step a), the snow-like particles are formed from block- or chipped-ice in a snow-making machine having a rotating impeller (e.g. of the type disclosed in U.S. Pat. No. 8,403,242). NB: The disclosure of U.S. Pat. No. 8,403,242 (Bucceri) is incorporated into the present Specification by way of reference.

In a second preferred embodiment, the present invention resides in a method for making snow, including the steps of:

a) forming at least one stream of cold air;
b) directing the at least one stream of cold air upwardly into the ambient air, the ambient air having a temperature below the freezing point of water; and
c) directing a spray or mist of water droplets into the stream to form flakes of snow.

Preferably, the method includes the further step of:

d) adding at least of the portion of the snow flakes formed in step c) to the stream of cold air before step b), the snow flakes providing nucleating agents for the water droplets.

Preferably, in step d), all of the snow flakes are added to the stream of cold air until the desired quantity of snow has been produced.

In addition, existing snow (e.g. from a snow blower) can be added to the stream of snow-like particles or the stream of cold air before step b) to provide further nucleating agents for the water droplets.

Furthermore, frozen ice from lakes, waterway, storage containers or other local sources can be supplied to the snow-making machine to be converted into the snow-like particles and/or added to the stream of cold air. Alternatively, ice produced by an ice-making machine may be supplied directly to the snow-making machine; or the ice can be produced and stored until required.

A plume or flow of the spray or mist of water droplets, directed into the respective streams, may be provided by a conventional fan snow making machine, the plume or flow being generated by the fan and water nozzles of that machine. (The combined air flows from the snow making machine of the type hereinbefore described; and from the conventional fan snow making machine, can ensure that the water droplets have a long "hang-time" for conversion into snow flakes; and that the snow flakes can be deposited some distance from where they are produced without requiring additional transport.)

In a third preferred embodiment, the present invention resides in an apparatus for making snow, including:

a snow-making machine having at least one chamber;

a first inlet to the chamber operably connected to a source of ice or recycled snow flakes;

a rotatable impeller within the chamber operable to form snow-like particles from ice;

an outlet from the chamber operable to direct the snow-like particles formed within the chamber to be blown in an upwardly directed stream by the air into ambient air having a temperature just above, or below, the freezing point of water; and at least one water sprayer, connected to a water source, operable to direct a spray or mist of water droplets into the stream to form flakes of snow.

Preferably, a second inlet to the chamber is connected to a source of air; and (optionally)

the chamber has a plurality of the first and/or second inlets and/or of the outlets.

Preferably the outlet is operable to direct the stream at an angle not less than 45° to the horizontal.

Preferably, the source of ice is an ice-making machine, or at least one storage compartment operable to store ice produced by the ice-making machine.

Preferably, a conveyor apparatus transfers at least a portion of the snow flakes, which have been formed, to the first or second inlet of the chamber and therein be impacted by the impeller to form snow-like particles incorporated into the stream.

Preferably the conveyor apparatus transfers substantially all of the flakes of snow which has been formed to the first or second inlet until the desired quantity of snow has been formed.

Preferably, the impeller has a plurality of blades, extending from a shaft rotatably journalled in the chamber for rotation about a horizontal axis which extends substantially transversely to the outlet, the outlet extending from a first end of the chamber.

Preferably, the first inlet is provided in a top wall or side wall of the chamber and the second inlet is provided at a second end of the chamber.

Preferably, an air fan is provided in an air passage interconnecting the second inlet and the chamber, to direct pressurized air into the chamber.

Preferably, a snow deflector plate is provided in an outlet passage, interconnecting the chamber and the outlet, to further pulverize the snow-like particles; and the snow deflector plate is adjustable to change the shape and direction of the stream from the outlet.

Preferably, the water sprayer is mounted substantially adjacent the outlet, so that the spray or mist of water droplets enter the stream just after the snow-like particles pass through the outlet, to maximise the nucleating of the water droplets by the snow-like particles. Preferably, the water sprayer is controlled by a sensor installed on the impeller that measures the load of snow (i.e. quantity) and then sends data to a PLC (program Logic controller) that, based on the information received, controls the water that is supplied through the valves that feed the water sprayer. This means the right amount of water is added to the snow feed being supplied so that the optimum amount of snow is made and no excess water is wasted. The PLC can also monitor the air temperature and humidity and receive data from sensors that can increase or decrease the water flow further depending on the existing ambient conditions.

Other preferred aspects of the present invention will become apparent from the following description.

Any notes or annotations on the drawings are by way of explanation only; and are not limiting to the scope of the invention.

BRIEF DESCRIPTION OF THE DRAWINGS

To enable the invention to be fully understood, and to enable the skilled addressee to put the invention into practice, a number of preferred embodiments will now be described, with reference to the accompanying illustrations, which are described in the following detailed description.

Figure 1:
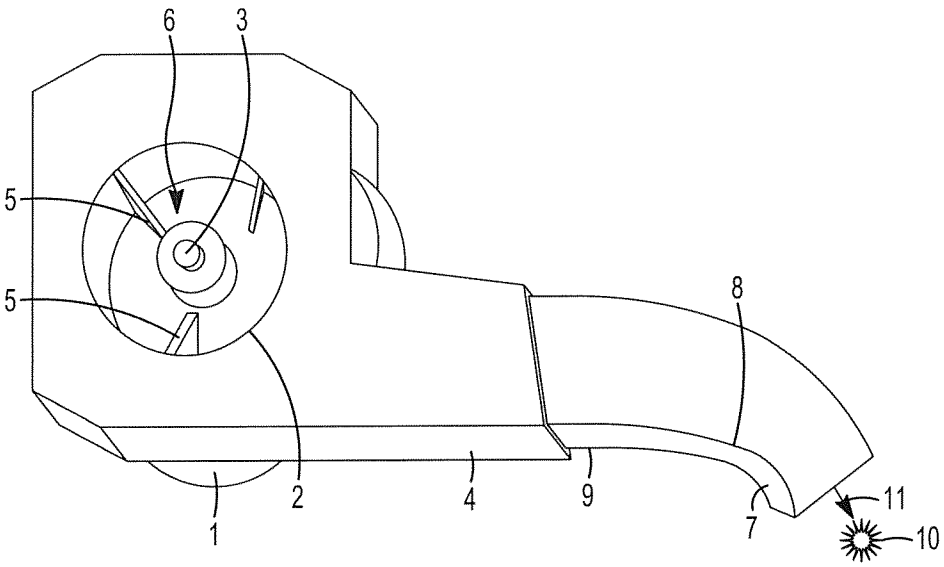
FIG. 1 illustrates an impeller, water supply and snow deflector.

Any annotations on the drawings are by way of explanation and/or illustration only, and are not limiting to the scope of the present invention.

DETAILED DESCRIPTION OF THE PREFERRED EMBODIMENTS

Before describing specific embodiments of the present invention, the following explanatory comments should be noted.

The snow making system (i.e. method and apparatus) of the present invention, can use water; ice in any shape; any form of snow (including existing- or recycled-snow); and/or a combination of these different forms of water ($H_2O$) to make and produce large quantities of snow.

The system is designed to be versatile in application; and can be used at ski resorts where the temperature is either above or below freezing (0° C.); or in urban locations for promotional events, such as snow fall parties or outdoors to create skiing or toboggan facilities. The snow making system can also be used in indoor ski centres or like installations.

At below freezing temperatures, the snow system of the present invention is based on the creation of snow using the patented impeller system disclosed in U.S. Pat. No. 8,403,242 (Bucceri); where snow is created from ice by using a high speed rotor, with special cutting blades, that smashes the ice into a fluffy snow product, that is long lasting and is easily laid on a ski field by the inbuilt blower that is also used with the cutting blades to make the snow.

While the impeller rotates, snow-like particles are created from ice and blown into the air; a high pressure mist of water is added to the stream of ice that is thrown skyward; and the ice acts as a nucleating source, that will freeze the water droplets that have been introduced; to create large quantities of falling snow, that can be used for ski fields or other recreational applications.

Experimental trials have established that the snow produced using the method of the present invention has a greater "hang-time" than snow produced by a conventional snow making system, as the present snow machine apparatus can throw the ice/snow e.g. 20 to 30 meters into the air, which gives the water droplets that are introduced into the stream a greater time to be frozen and converted into additional snow.

In addition, the experimental trials have established that the quantity of snow produced can be much greater than for a conventional snow making machine; as the quantity of ice introduced to act as a nucleus for the water droplets to freeze on can be much greater than a conventional snow making system. A standard snow making fan gun, operating at −5° C. and 30% relative humidity, would typically create around 18 liters of ice seeds per minute, when connected to 60 CFM air compressor operating at 80 psig air pressure, and where the ice seeds act as the nuclei to produce snow from 244 liters of water per minute supplied at a water pressure of 20 bar (300 psig). The system of the present invention can produce from 400 kilograms to 2000 kilograms per minute of ice crystals; enabling over 100 times more ice to be introduced to the air water mix as nuclei for the snow to be produced:

1. Depending on the temperature of the ice, there can be greater level of freezing capacity within the ice or recycled snow that is used. For example, if the ambient air temperature was −10° C., then each pound (0.45 Kg) of ice would give up 5 btu's of heat per pound to the water droplets, as its temperature is raised from −10° C. to 0° C. This is in addition to the freezing effect from the normal function of the snow making machine being used in a similar manner to an existing snow making fan machine at temperatures below freezing.
2. The apparatus can be used at temperatures as high as 0° C., with a relative humidity of 100%; whereas conventional snow making fan-guns can only effectively operate when the ambient temperature is no higher than −5° C. and with a relative humidity no greater than 50%.

In experimental trials, it has been found that, at air temperatures of −10° C. and below, up to 5 times the volume of water can be added to the ice-based snow, enabling the creation of up to 6000 kilograms of ice per minute, or 30 cubic meters of snow per minute, at a density of 0.2.

The actual quantity of snow produced will fluctuate depending on e.g. the ambient temperature and humidity; the temperature of the introduced ice or snow (if any); and/or the temperature of the water. The lower the temperature(s), and/or the lower the humidity, the greater the quantity of snow that can be produced.

In the experimental trials, it has even been possible to use the snow making impeller system to make snow without the requirement for ice, when the temperature is below freezing and the water is introduced into the cold stream of air being produced by the impeller.

Unlike conventional snow fan systems, there is no requirement for the provision of fan(s) and/or air compressor (s); and in the trails, snow making has been achieved at all air temperatures below freezing.

Another big advantage is that the snow making machine of the present invention will accept any form of ice to make snow, and this can additionally include existing snow that is at the resort; frozen ice from adjacent lakes or waterways; and/or ice made from any form of ice making machine.

The ice used to produce the snow can be in any form or size for introduction into the system and enabling fresh snow to be made.

This leads to a method of snow "cloning", whereby a new innovative method of making snow, as hereinbefore broadly described, is provided The method using the apparatus described in this application allows for the most efficient and guaranteed snow making system ever developed to guarantee snow production for ski resorts.

In more specific terms, the snow making method of the present invention will be hereby described as follows:

- A standard ice maker is installed produce the initial quantity of ice used as the starter requirement for snow making by the present system. The ice maker can be a standard commercial unit; or water can even be frozen in utensils (like buckets) in a freezer-room, either onsite or offsite. The capacity of the ice maker can be anywhere from 5 tons to hundreds of tons per day. The cost of producing the ice can be as low as US$3 per ton.
- If the ski resort wants to guarantee opening days, then an air-conditioned storage area can be installed, where the ice produced as hereinbefore described can be stockpiled for days, or weeks, or even months, for later use when the ambient air temperature is about, or below, freezing.
- When the ambient air temperature is above 0° C., the present snow making apparatus can create up to e.g. 120 cubic meters of fresh snow per hour; and can distribute the snow evenly for snow skiing; and therefore guarantee fresh snow for an opening day. The ice in storage, that may have taken months to produce, can be converted into snow and distributed in 1 day, or less, using the present snow making method.
- When the temperature is below 0° C., the ice can be turned into snow and "cloned" by the addition of fresh water introduced by the fog jets of the water sprayer. The amount of water added will depend on the ambient conditions and on the temperature of the ice; and a single machine could multiply the snow being produced by the machine at a rate of e.g. 120 cubic meters per hour by 1 to 12 fold; thereby creating an additional 120 to 1140 cubic meters per hour of fresh high quality snow.
- The snow created can then be "re-cloned", which in turn can multiply this snow again by 1 to 12 times, creating a very high multiplying effect from the stored ice.

The advantages of this method at ambient air temperatures of 0° C. to −3° C., are enormous; as this is a temperature range in which conventional snow making machines cannot operate. The snow production potential is enormous and, in theory, could provide all the snow required for a single ski run for a season of e.g. 16 weeks in 1 or 2 days of operation, all from a starting base as low as 100 tons of fresh ice at a cost as little as US$300.

An explanation of the advantages of using the apparatus and methods described in this Patent Application now follow:

- A 25 ton flake ice machine produces 100 ton of ice after 4 days and the temperature drops to −1° C.
- The 100 tons of ice is processed through 3 snow making machines at a rate of 1 ton per minute per machine; and 300 cubic meters of snow is produced, which, when mixed at a ratio of 1 to 1 with 100,000 liters of water, to create 600 cubic meters of snow. (i.e. with a weight of 200 tons)
- With 3 machines capable of 1 ton of ice per minute, this process takes approximately 30 to 35 minutes.
- The 3 machines can then take the 200 tons of snow produced; and within the next 60 minutes, produce 1200 cubic meters of snow; and then, in the following 120 minutes, increase the produced 1200 cubic meters into 2400 cubic meters of snow.
- Within the next 4 hours, the 3 machines can increase the 2400 cubic meters into 4800 cubic meters; and so on, with each machine capable of producing 7200 cubic meters of snow at a weight of 24000 kilograms in a 24 hour period at a snow/water ratio of 1 to 1 only.
- Some ski resort operators will know that 7200 cubic meters of snow, spread over a depth of 1 meter, can last many months during a typical ski season. Thereby, the present invention can guarantee all the snow requirements for the whole ski season with only 1 day's snow production at minimal cost from a minute amount of snow.

The snow making apparatus can be made to produce more or less snow depending of the motor and impeller fan sizes, plus the number of water nozzles provided; and the ice used in the system can be purchased and bought in by trucks, for the starter requirements; or old snow can be used and refreshed and recycled to make more snow.

When used in an indoor snow making centre or ski resort, the ice can be held in a storage room at low temperatures to provide more freezing capacity when the snow is being made from water.

In addition, snow made from conventional snow-guns can be immediately collected, recycled and multiplied using the present method and apparatus.

The snow making machine makes inexpensive snow at below freezing temperatures, using a high pressure water pump that introduces the water into the air stream, ambient air, and/or either snow that is recycled to create more snow, or new ice formed by conventional or unconventional snow making methods and the apparatus, as hereinbefore described.

Another advantage of the snow making system is the ability to recycle old snow, that may be icy or "slushy", to produce new high quality fresh snow, that is also of a greater volume than the initially available snow. In addition, old snow that is stockpiled on roads or off-piste can be collected for use.

The snow making apparatus components and methods can be applied to a standard snow blower that cleans roads and paths of snow and blows them into the sky; where the water spray or mist can be mixed with the stream of snow (and air) discharged by the snow blower.

In applying the present technology to a snow blower, the apparatus can be made movable and the water can be mixed with the snow to multiply the snow effect.

The apparatus described in the invention can also be made movable by adding the driving mechanism to collect and produce the snow while the vehicle is moving.

A single machine using a 30 kw motor can have a capacity of up to 30,000 to 60,000 kilograms of snow per hour made from recycled snow, or new ice that is used for ice seeding purposes; and can also provide for up to an additional 30,000 to 720,000 liters of water to be added to the snow produced from the ice, creating an enormous potential snow making capacity.

At a cost of energy of US10 cents per kilowatt hour, the total energy cost of making this snow would be as low as USD$3.00 for 300 cubic meters of snow, when recycled snow is being used for the snow making. This is equivalent to, or less expensive, than, an existing fan gun at around US1 cent per cubic meter of snow produced.

Over a 12 hour period, one machine could create a staggering 3600 cubic meters of snow at a cost under US$36 of energy supplied for the snow making apparatus as described above.

NB: The cost of the snow moving equipment, such as front end loaders, skid-steer loaders, backhoes, etc., and labour required to load the machines would be additional to this.

The other major advantage is that the snow making machine can be used in any temperature below freezing; and even in above freezing temperatures, the snow can still be produced by introducing ice or recycled ice or snow in any form into the machine that turns this ice into fresh snow, that can be thrown e.g. 30 meters or more into the air and which can be used both outdoors, or in indoor ski centres for promotional events or for skiable snow for tobogganing or skiing.

However, unlike standard ice making system technology, the present snow making system is guaranteed to produce snow, and can produce snow at temperatures just above, or below, 0° C.; and the system is easy to install and operate at a ski resort.

The system can be also operated by a hire refrigeration chiller such as that provided by "Aggreko" (Trade Mark) to create the cooling required to make the ice in the water delivery pipe that feeds the snow making apparatus.

Where the resort has a conventional fan snow making machine, such machine can be operated with the snow making machine of the present invention. The conventional fan snow making machine is located adjacent the present snow making machine and is operated to direct a plume or flow of water from the nozzles (and cold air) into the stream of snow-like particles produced by the present machine, to be mixed therewith. The combined air flows, generated by the 2 machines, can increase the "hang-time" for the conversion of the water droplets into snow flakes and/or deposit the snow flakes at a greater distance from the machines than is possible with either machine alone.

In a practical application, the snow making system technology is preferably made up of three main components.

The first component is a conveyor system that prepares the ice and delivers the ice to the snow making machine crusher. The second component is the snow making machine fan/impeller crusher, preferably utilising the impeller disclosed in U.S. Pat. No. 8,403,242, which is an improved ice making system that can convert frozen water into high-quality snow that can be used in many snow and ice related applications. The third component is the water (e.g. in droplets in a spray or mist) that is pumped into the snow stream to multiply the amount of snow that can be made. This water is preferably controlled by a PLC controller to release the correct amount of water to the snow produced by the impeller converting the ice/snow introduced into snow seeds.

The technology to make the ice is relatively simple and can use old snow, ice harvested from frozen lakes or other waterways, or ice that is made with systems based on existing technologies (including tube, flake and block ice making machines) and non-standard ice making systems. For example, the present invention can make ice by freezing water placed in containers that are left to freeze to ice in subzero temperatures. For example, at a ski resort, it would be possible to use 25 mm-150 mm (1'-6') diameter (preferably 38 mm diameter) plastic- or metal tubes that are filled with water and then frozen by the ambient air as the ice making component of the system.

The before-mentioned tubes are filled with water; and the water inside the tubes is frozen in whole, or in-part, when the tubes come in contact with sub-freezing cold ambient air, a cryogenic material, a low temperature coolant solution, or a refrigerant.

After the water in the tubes has frozen, the ice can be removed by partial-defrosting, mechanical or manual means, and can be transported automatically to the snow making machine by the upward water flow and flotation by water flowing though ice delivery pipe(s) connecting the tubes to the snow making component of the system, to make the high quality snow for ski slopes e.g. for snow skiing.

After the ice has been removed from the tubes, the tubes are again filled with water, so that the ice-making process can be repeated.

The snow making system preferably has a combination snow blower and snow maker, which is positioned directly at the outlet end of the ice delivery pipe, so that after the ice tubes are created by freezing and released by hot gas defrost they then float to the outlet of the water pipe where they are broken into small pieces and separated from the flowing water, to be delivered efficiently to the said snow making machine and converted into snow and quickly blown from the system onto a ski slope, or to a location where the snow is required for use.

The snow making impeller system, as disclosed in U.S. Pat. No. 8,403,242, is arranged so that ice fragments, ice cubes, ice tubes or ice pieces come in (violent) contact with a baseball bat like component moving at a speed of between 150 to 300 km/h, so that the ice is pounded into fine snow-like fragments or pieces, that can be blown a distance of up to 20 to 50 meters from the snow making machine.

One such machine can be positioned or mounted to rotate through a full 360° degrees, or through 180°, to cover a large area with fresh snow. The snow coverage can be affected very quickly because each machine can produce up to of 50 cubic meters of snow per hour with 1 impeller, or up to 200 cubic meters per hour with 4 impellers or an extended blade.

It has been further found in trials that the snow making component of a system capable of making 2500 $m^3$ of snow per day from 1000 tons of ice can be built to take up little space and be simple to manufacture and inexpensive to build and operate.

At present, many ski resorts are concerned about the effects of global warming, which makes existing technologies that rely on cold air temperatures to make snow difficult to operate, or to justify the capital expenditure on when the ambient air temperatures are becoming warmer and the use of such expensive equipment as an investment. The present system overcomes this problem by providing equipment that can make snow 24 hours a day/365 days of the year. Unlike other conventional snow or ice making applications used at ski resorts, the present invention can make high quality snow; and the snow making process can commence by producing and storing the ice many weeks or months in advance of the ski season, thereby being guaranteed full snow coverage on a set day of the year.

Furthermore, the ski resort operator can know in advance that they will have sufficient snow coverage to be open on a preset date for a set number of ski slopes, and that the depth of snow laid can last the whole ski season.

This option has never before been available to any ski resort in the world; and when this is combined with high quality snow and low cost production; the present invention will change ski resort operations for ever and revolutionize the industry.

The factors which improve the efficiency of the presents snow making system include:

a) the ability to make snow simply efficiently at any temperature from just above 0° C.;
b) all of the water that enters the system is converted to snow and blown into the area where the snow is required; and
c) the rotational speed and the construction of the impeller blades, that contact & shatter the ice, produces the snow which can be used for a variety of applications.

The following chart shows the optimal radius of the impeller blades from the centre of the impeller and the required rotational speed that the impeller blades must be moving to generate the forces to generate and deliver the snow-like particles; where the machine has the impeller of the type disclosed in U.S. Pat. No. 8,403,242.

IMPELLER CHART INFORMATION

| A Speed Required km/hr | B Speed Required mts/min | C Radius of Blade meters | D Circumference of Impeller Meters | E RPM Needed for Supply |
|---|---|---|---|---|
| 200 | 3333 | 0.01 | 0.06 | 53030 |
| 200 | 3333 | 0.02 | 0.13 | 26515 |
| 200 | 3333 | 0.05 | 0.31 | 10606 |
| 200 | 3333 | 0.1 | 0.63 | 5303 |
| 200 | 3333 | 0.2 | 1.26 | 2652 |
| 200 | 3333 | 0.5 | 3.14 | 1061 |
| 200 | 3333 | 1 | 6.29 | 530 |

The chart above shows the tangential speed required at the tips of the blades to ensure that the ice is turned into a high quality snow product that is capable of being thrown over 20 m away from the snow making system.

From the chart. It can be seen that a blade with a length of 50 cm, with the impeller rotating at a speed of 1061 rpm, operates in the same manner as a blade that is 20 cm in length but where the impeller is rotating at a speed of 26,515 rpm.

It has been further found that when a blade travels at this speed, that the capacity of ice that can be fed into such a turning impeller can be as high as 5 kgs per second for a single 4-blade impeller that is connected to a motor with a capacity of at least 30 kW. This will provide for a total production of up to 432,000 kg of ice per day. This would amount to 1080 $m^3$ of fresh snow production in a 24-hour period.

This present invention can employ a number of different forms of this machine. For example, a one-impeller system with four 20 cm long blades could be made to connect to a standard motor to generate a high daily snow making capacity. To accommodate such a system, the total size of the equipment necessary needs to be at least 50 to 77 cm in diameter with a further allowance for the mechanical controls to turn the Impeller. Alternatively, if 20 cm long impeller blades are used, the size of the system to accommodate such equipment would be much less and could be as much as 10% of the previously described size. When added to this, the possibility of adding similar sized impellers, it can be seen that the capacity of such a small unit could allow double (i.e. 2 impellers) to 10 times more capacity if multiple impellers were added to the system. In doing this a snow making system could be created where the snow making blower component could have a capacity of 10,000 $m^3$ of snow per day or more.

This is a very important factor as the time taken to supervise the spreading and production of snow can be greatly reduced so that there is a saving in labour and in energy requirements due to the fact that the snow can be produced and distributed when energy prices are at their cheapest during the day.

Also, because of the tip speed created at the blade ends, and also the thrust of this snow throw which can be in excess of 20 m, it would be possible to utilize such a system to throw water particles into the air at sub-freezing temperatures to also make snow in a similar manner to conventional means.

The snow making Impellers can also be made to sit on rotating platforms that will automatically turn the units to get uniform snow coverage over a large area. At the same time the snow throwing barrel can be moved up and down to get a uniform coverage as well. The machine can also be mounted on a snow transporter or trailer and be readily moved around the mountain to multiple distribution points.

FIG. 1 illustrates an impeller, water supply and snow deflector that forms the basis of the snow making system and illustrates how the system would operate.

The snow-making apparatus 1 is manufactured from stainless or other high impact metal and the ice is introduced though the opening 2. The impeller shaft 3 is rotatably journalled in the machine 1 and is driven at a high rotational speed (see the Chart above) by suitable mechanical drive means (e.g. an electric motor & transmission). The impeller shaft 3 spins the high-impact impeller blades 5 of the rotating tubular impeller 6 to pulverise and throw the (snow-like) ice particles at high velocity through the outlet pipe 4. Sensors (not shown) are connected to the impeller shaft 3, and calculate the load on the motor for blowing the snow and send this data to a PLC controller that converts the data to analogue and opens the solenoid valves releasing the water at the correct ratio from 1 to 1 to 12 to 1, depending on the snow flow.

As the snow-like particles are exhausted from the snow making apparatus 1, they collide with the snow deflector plate 7 that has a raised centre line 8 and the snow-like particles are further pulverised and thrown upwardly at a very high speed. The snow defector plate 7 can be adjustable and used to fan the snow at any angle sideways or upwardly, depending on the curvature and shape of the plate 7. The plate 7 is connected to the snow making apparatus 1 by adjustable connecting rods 9. The water nozzle 10 is connected to the water hose 11 and supplies water into the snow making stream created by the apparatus 1. The plate 7, the nozzles) 10 and the water manifolds are preferably heated to prevent freezing during operation.

Figure 2:
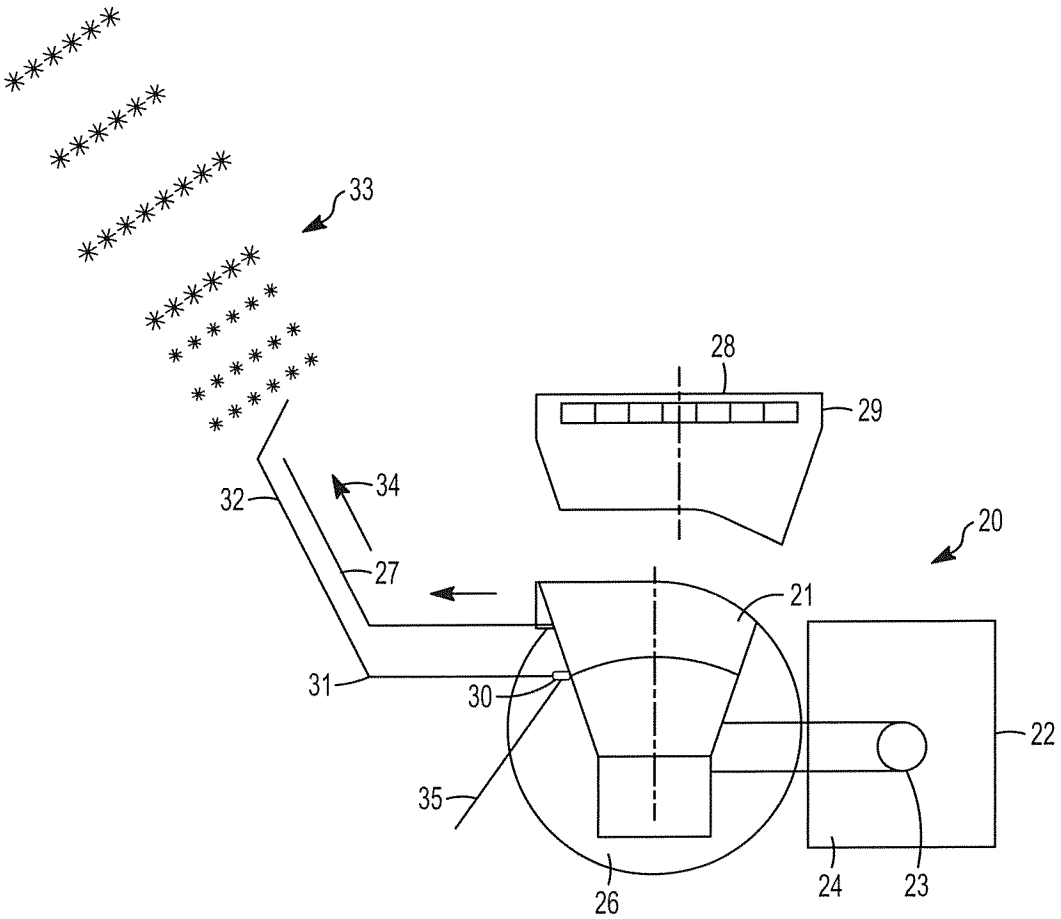
FIG. 2 illustrates a snow-making apparatus and components thereof.

FIG. 2 shows the snow making apparatus 20 and the components that make up the apparatus. The hopper 21 collects the ice and feeds the impeller 26 as previously described in FIG. 1. The Impeller 26 is connected to a motor 22 that has a pulley and belts 23 that drive the impeller 26. The adjustable deflector plate 27 is connected to the apparatus 20; and the water nozzle 30 is connected to delivery hose 31 that has a connector 30, on the apparatus 20, which is connected to the water supply hose 35.

As the snow 34 is thrown upwardly, the water is introduced into the snow stream at 32 and the water freezes in the snow stream I.e., as the water molecules freeze onto the outside of the snow blown from the impeller 26 and multiplies as the collisions continue with the water droplets before hitting the ground.

Figure 3:
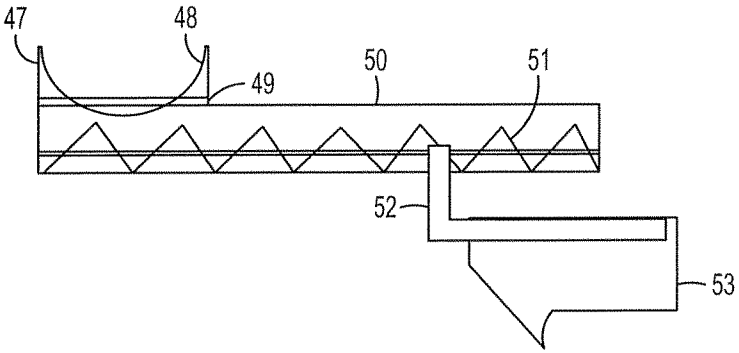
FIG. 3 illustrates a conveying system.
Figure 5:
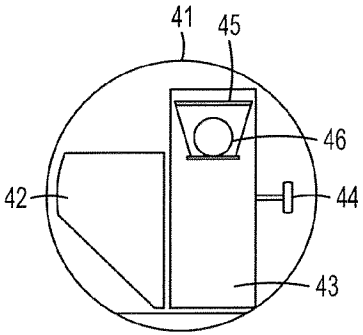
FIG. 5 illustrates a conveying system.

FIGS. 3 and 5 illustrate the conveying system for feeding old snow to the inlet of the snow making the apparatus.

FIG. 3 illustrates the conveyor 50 provided with a helical screw and shaft 51. The ice, or old snow to be recycled, is introduced through opening 48 that has a metal grate 49 to ensure that only snow particles sized under 100 mm in diameter are introduced into the system. The conveyor 50 is connected by frame 52 to the hopper 53, which is placed over, and connected to the delivery hopper 42, illustrated in FIG. 5

Referring to FIG. 5, the delivery hopper 42 enables the ice to be fed through a first inlet to the impeller 43 that is driven by pulley 44, in turn connected to a motor (not shown). The snow impeller, motor and hopper are housed in an enclosure 41 and the snow exits through outlet 46 and thrown onto the deflector plate 45.

Figure 4:
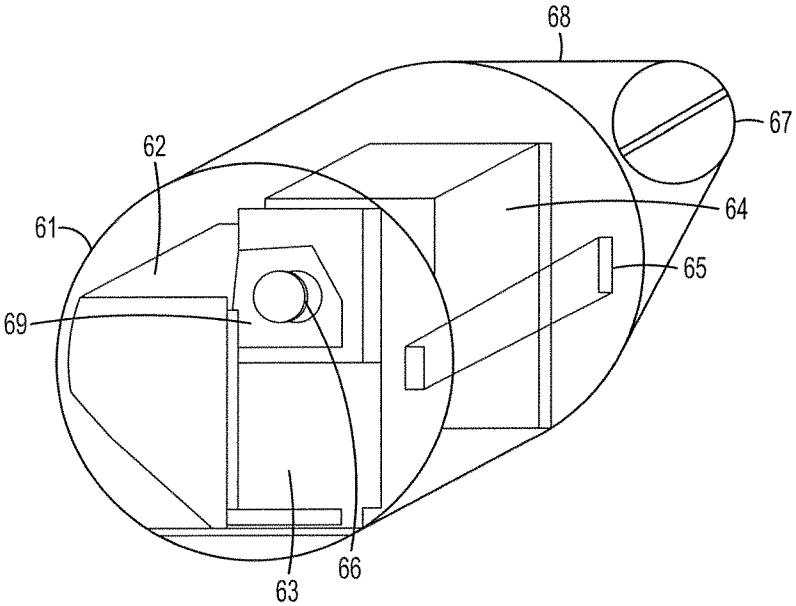
FIG. 4 illustrates an alternative embodiment of a snow-making apparatus.

FIG. 4 illustrates an alternative embodiment of the snow making apparatus 61, where the enclosure 68 is configured to look like the nacelle of a jet engine. The delivery hopper 62 is connected to the first inlet to the Impeller mechanism 63, which is driven via pulleys and belts 65 by the motor 64. The snow produced is ejected through outlet 66, connected to the defector plates 69. The electrical controls and water connections are connected to a switchboard with a PLC controller that monitors data from sensors that measure air temperature, humidity, motor load (e.g. current input), to provide sufficient water to optimize snow production 67.

Figure 6:
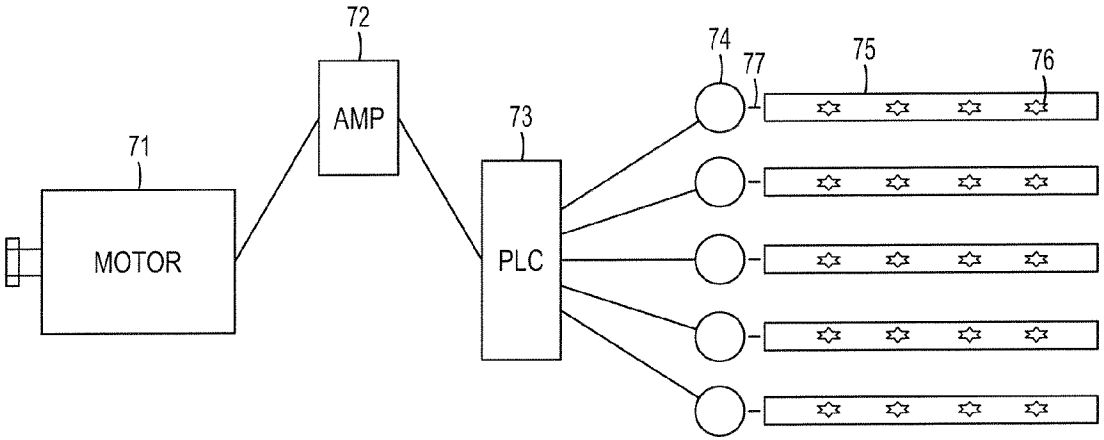
FIG. 6 illustrates a schematic circuit diagram for a PLC controller.

FIG. 6 illustrates a schematic circuit diagram for the PLC controller. The motor 71 (which drives the impeller) is connected to a voltage/ampere/torque measuring sensor 72 which sends data to the PLC 73. The PLC 73 controls the solenoids 74 that control the feed of water tot the water manifolds 75 which supply the spray nozzles 76 dependent on the measured load current load of the motor 71. For example, if the load is measured in Amperes (A), and the input current to the motor 71 is in the range 40 A-50 A, all the solenoid valves 77 (controlled by solenoids 74) will open to provide maximum water flow through the nozzles 76. If, however, the input current is in the range 25 A-30 A, then only e.g. 50% of the solenoid valves 77 will open. At minimum input current, no solenoid valves 77 will be opened. Additional sensors can monitor ambient temperature, air humidity, water temperature, wind speed and/or direction, and/or other factors to ensure maximum efficiency in the production of the snow.

Figure 7:
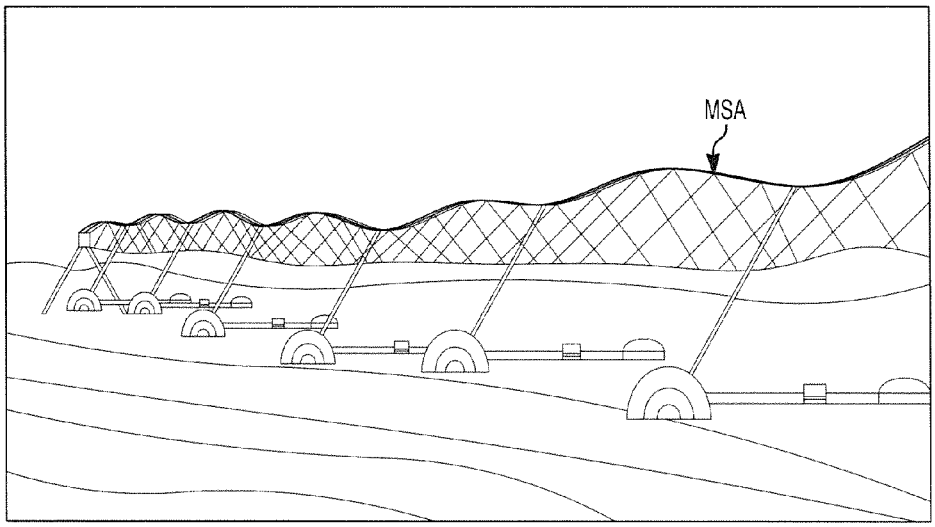
FIG. 7 illustrates an example of a mobile spraying apparatus.

FIG. 7 illustrates an example of a mobile spraying apparatus MSA to pre-wet the ski surface before the produced snow is applied thereto. The spraying apparatus MSA can also be used to create ice on a ski slope by simply spraying water onto the hill at below freezing temperatures. As the water turns to ice the ice is harvested by machines with a blade and scraper and the ice is put through the snow fall machine apparatus and snow is made. The ice can also be stored for later use.

Figure 8:
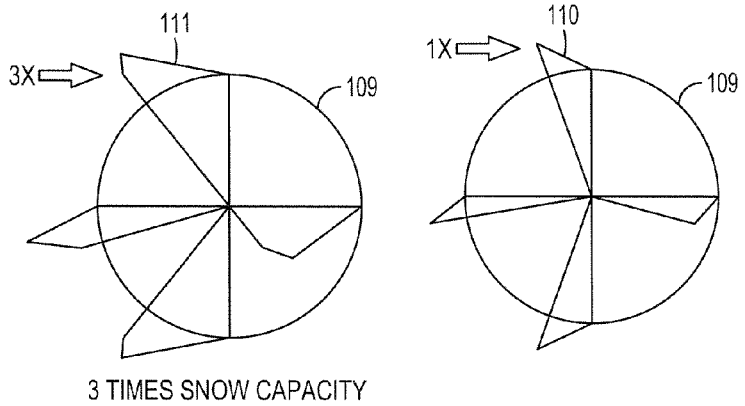
FIG. 8 illustrates how incoming snow-like particles can be directed to impinge on an impeller blade.

FIG. 8 illustrates how the incoming snow-like particles can be directed to impinge on the impeller blades 110 or 111 on the impeller plate 109.

Figure 9:
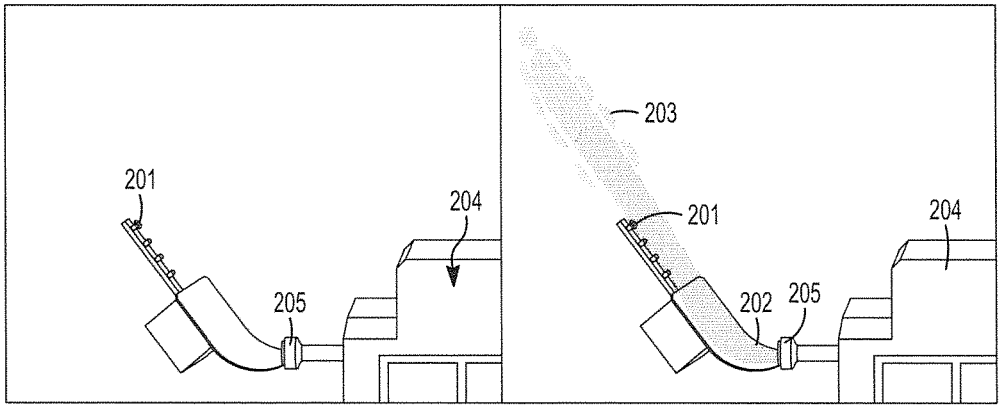
FIG. 9 illustrates a method of mixing water spray from a nozzle into an air or ice stream from the outlet of the snow-making apparatus.

FIG. 9 illustrates one method of mixing the water spray from the nozzle 201 into the air or ice stream 802 from the outlet 205 of the snow making apparatus 204 to make high quality snow 203. It can be seen how efficient the method for snow making is and how easily the water mixes with cold stream of air or snow that is produced by the apparatus 204.

Figure 12:
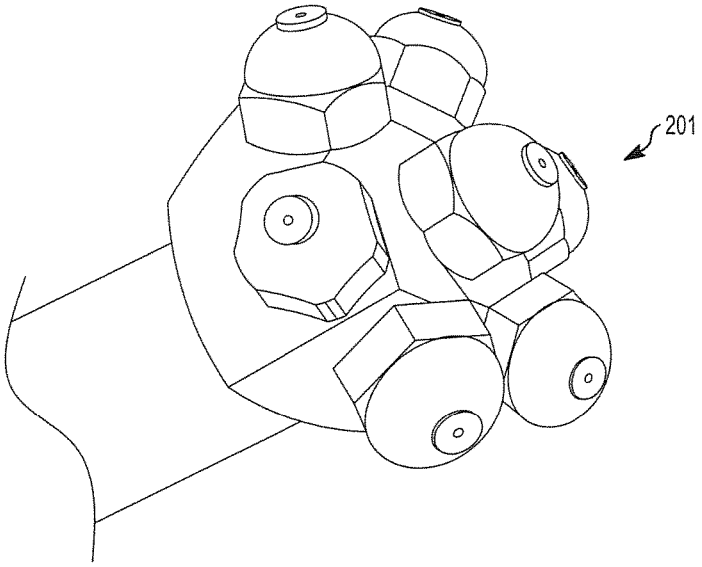
FIG. 12 illustrates a nozzle.

FIG. 12 illustrates an example of the nozzle 201, which will be hereinafter described in more detail with reference to FIG. 24.

Figure 10:
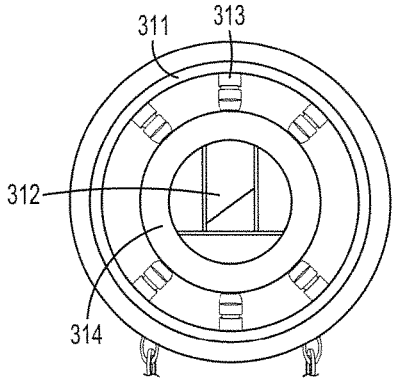
FIG. 10 illustrates a method of mixing water spray from nozzles.

FIG. 10 illustrates another method of mixing the water spray from the nozzles 313. In this embodiment, the nozzles 313 are connected around the discharge pipe 311 and the water spray 314 is mixed with the large volume of air or snow produced by the impeller blades 312. With this method, the snow can be produced in any temperature and any humidity.

Figure 11:
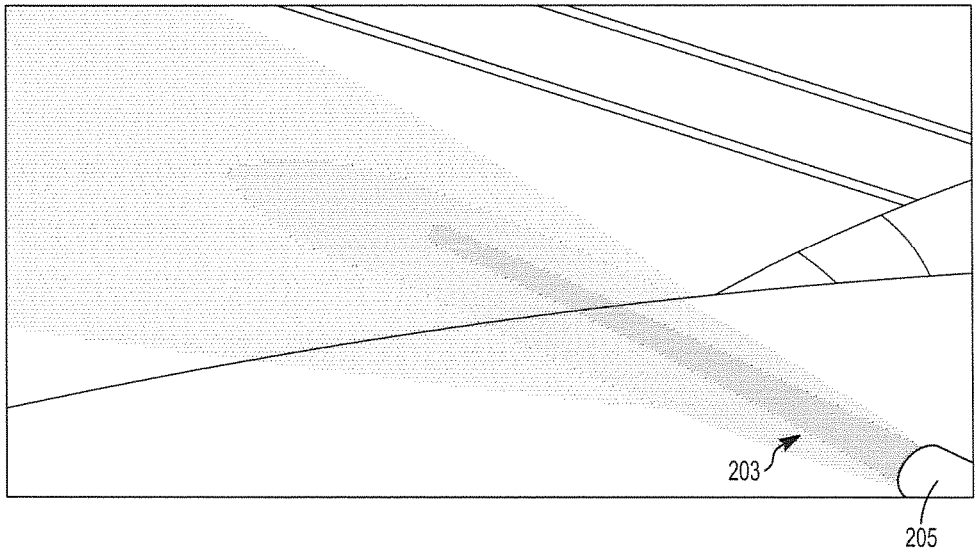
FIG. 11 illustrates snow being blown from an outlet.

FIG. 11 illustrates the snow 203 being blown from the outlet 205 described in FIG. 9, employing such a method.

FIG. 11 further illustrates the high quality snow produced by the nozzle and ice method. The snow is very much in a powder form.

Figure 13:
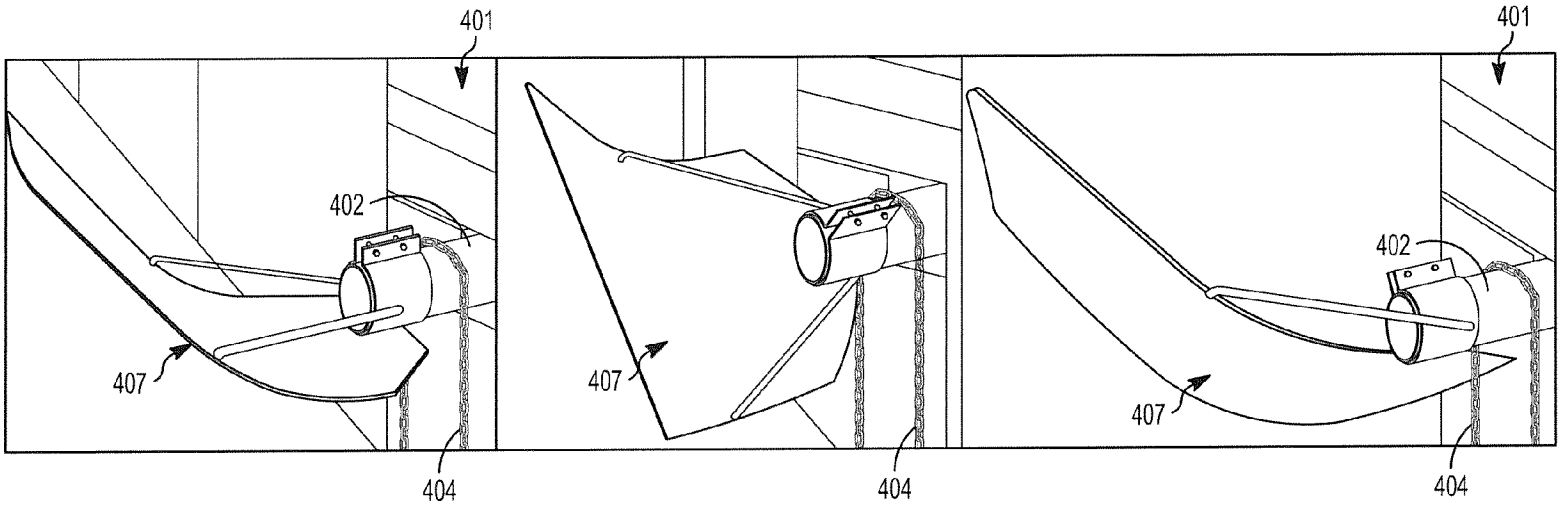
FIG. 13 illustrates alternative positions for a deflector blade relative to an outlet of a snow-making apparatus.

FIG. 13 illustrates several examples of alternative positions for the deflector blade 407, relative to the outlet 402 of the snow making apparatus 401. The deflector plate 407 can be rotated about an axis (defined by the outlet 402), where the rotation of the deflector plate 407 which is effected by an actuator 404 to provide maximum distribution of the snow on the ski field.

Figure 14:
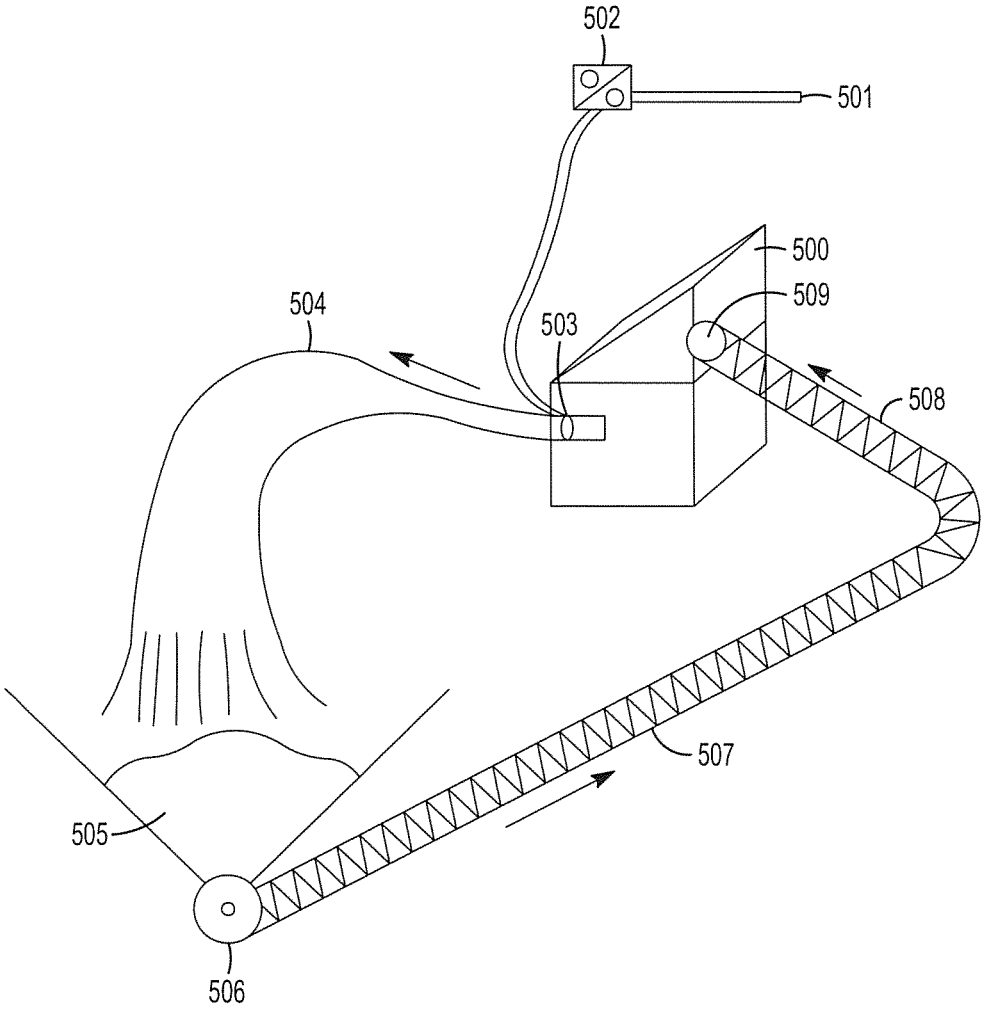
FIG. 14 illustrates a method of making snow.

FIG. 14 shows a method of automatically or semi-automatically making snow in an indoor ski centre or outdoor ski field, where a flow of water 501) is fed, at a controlled rate, through a solenoid valve 502 to an outlet 503 of the snow-making machine 500. The snow 504 is collected in a hopper 505, which has an outlet valve 506, connected to a screw-conveyor having conveyor sections 507, 508 (which may be hingedly- or flexibly connected together) to transfer to snow to the snow inlet 509 of the snow-making machine 500.

Figure 15:
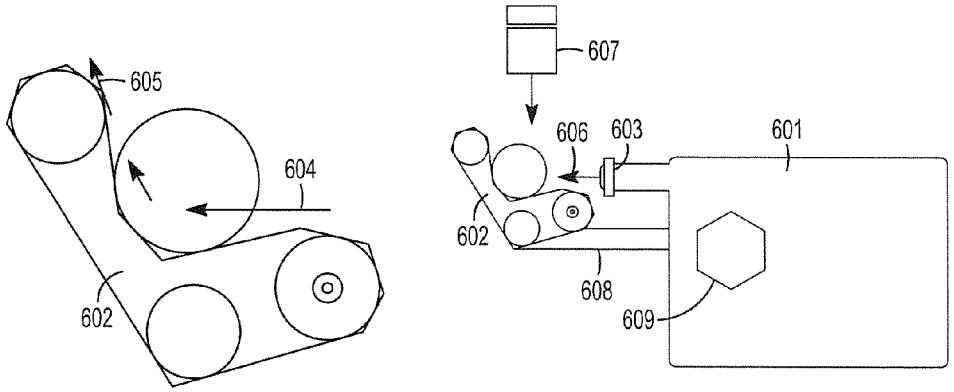
FIG. 15 illustrates a snow making system.

FIG. 15 illustrates an advanced version of the snow making system that allows for the snow that is made to be thrown a great distance. The slinger mechanism can be used with the "ice to snow" or "water and ice to snow" operation. This apparatus is added when a distance of 20 meters plus is required for the snow to be thrown. Referring to the drawing, the snow making apparatus is shown at 601 and ice and air is added through opening 609. As the ice enters the snow making apparatus, the ice is converted to snow and mixed with the water spray 603 and snow is thrown from the machine at high speed at point 606 into the moving conveyor belt of slinger 602, and the snow is thrown a great distance 605 in the process. The slinger 602 is made up of a series of pulleys as shown and an endless conveyor belt that increases the speed of the out coming snow and throws it high into the air and a great distance from the machine.

Figure 16:
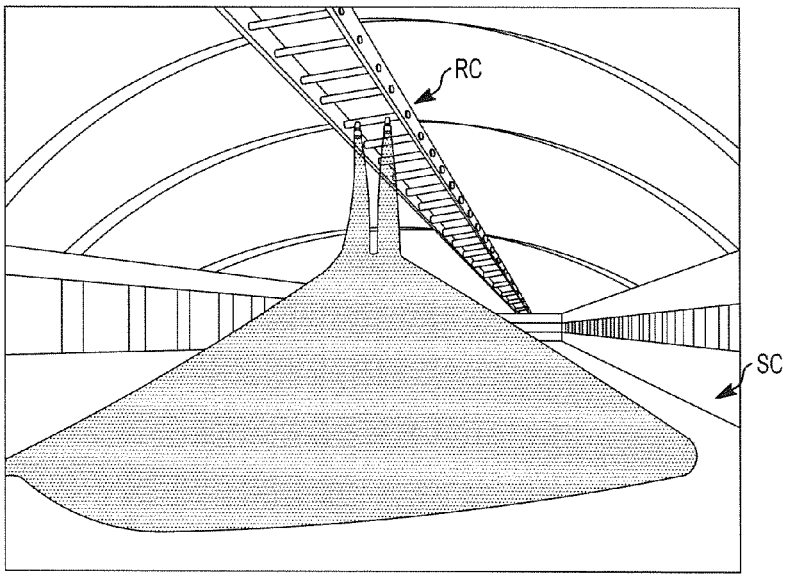
FIG. 16 illustrates a roof conveyor system.

FIG. 16 illustrates a roof conveyor system RC that can be set up to feed the ice or snow directly to the snow making machines or the ground so that snow can be made at many locations in an indoor ski centre SC.

Figure 17:
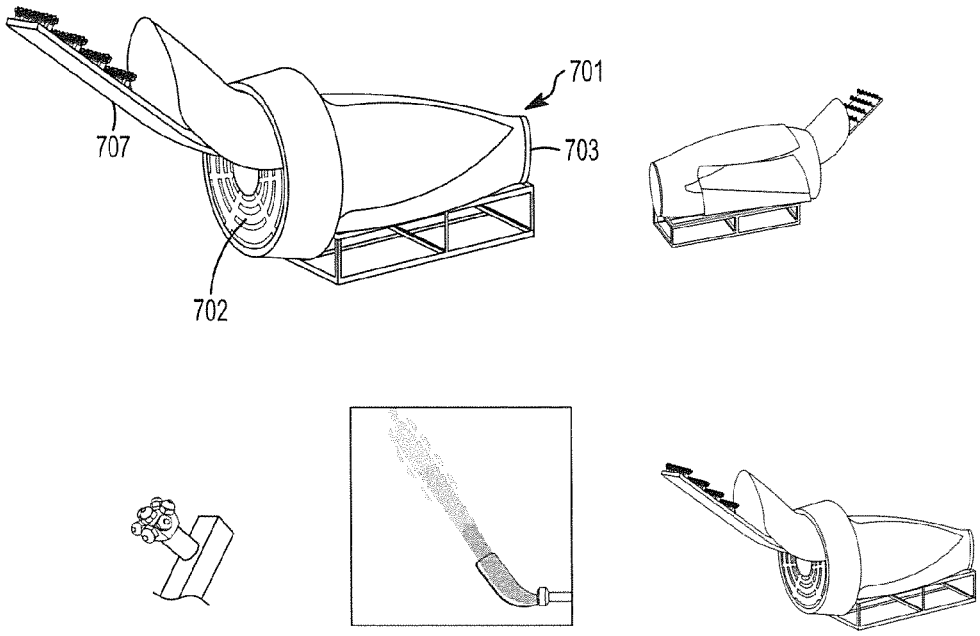
FIG. 17 illustrates a snow making apparatus.

FIG. 17 illustrates a further embodiment of the snow making apparatus 701 that can be made to be operated by a diesel, petrol, natural gas or electric motor.

Figure 18:
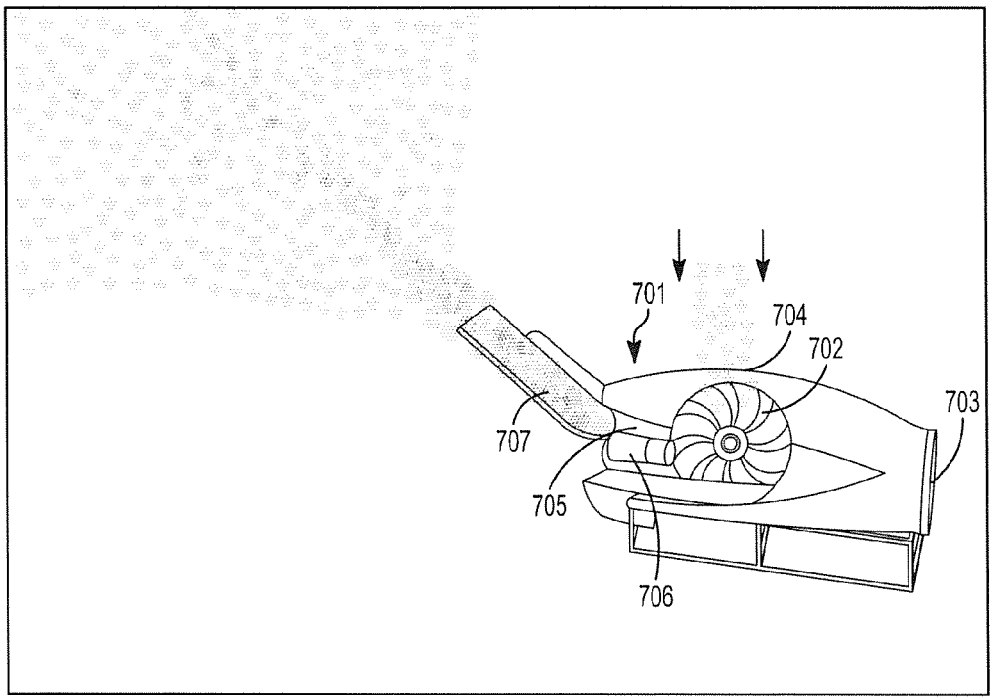
FIG. 18 illustrates an apparatus including a spinning impeller.

FIG. 18 illustrates the apparatus 701 in use where the spinning impeller 702 is rotating at 2300 rpm and air is introduced to the impeller 702 by a second inlet 703. Ice or snow is added via a first inlet 704 and snow is produced which is them mixed with water introduced as droplets into the snow that has been produced and the water is frozen into snow and the production of the original snow is multiplied. The snow passes through outlet 705, the water is introduced by a water sprayer 706 adjacent the outlet 705; and the resulting snow is deflected by the deflector plate 707.

Figure 19:
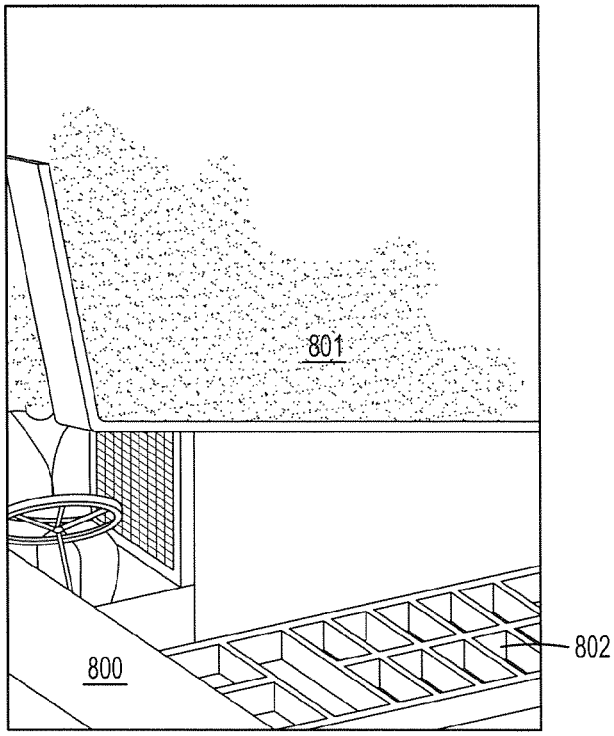
FIG. 19 illustrates a front end loader feeding recycled snow into a hopper.

FIG. 19 shows a front end loader 800 feeding the recycled snow 801 into the hopper 802 connected to an auger (not shown) that feeds the snow making apparatus.

Figure 20:
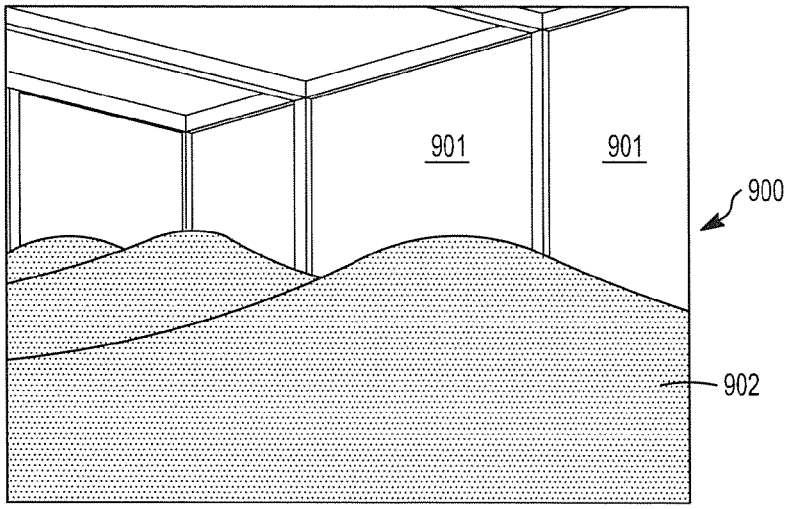
FIG. 20 illustrates an ice storage room with commercial ice makers in the roof.

FIG. 20 shows an ice storage room 900 with commercial ice makers 901 in the roof collecting ice 902 for later snow making use.

Figure 21:
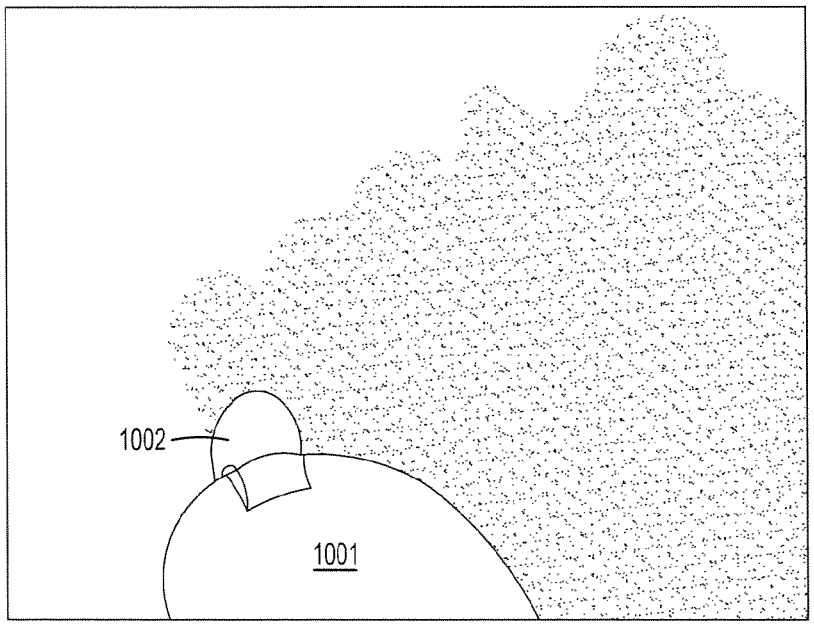
FIG. 21 illustrates an apparatus in use with fog jets operating at the front of a machine and water spray being blown.

FIG. 21 shows the apparatus 1001 in use with only the fog jets operating at the front of the machine and the water spray 1002 being blown into a below freezing environment to make snow in a similar manner to a conventional snow making machine.

Figure 22:
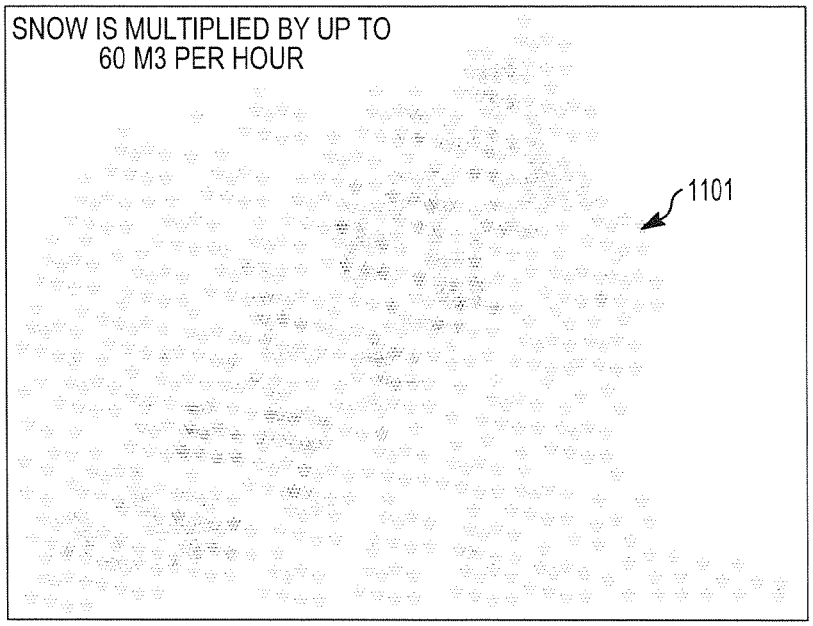
FIG. 22 shows recycled snow or ice.

FIG. 22 shows the results of the recycled snow or ice 1101 being added the apparatus and fresh snow being made.

Figure 23:
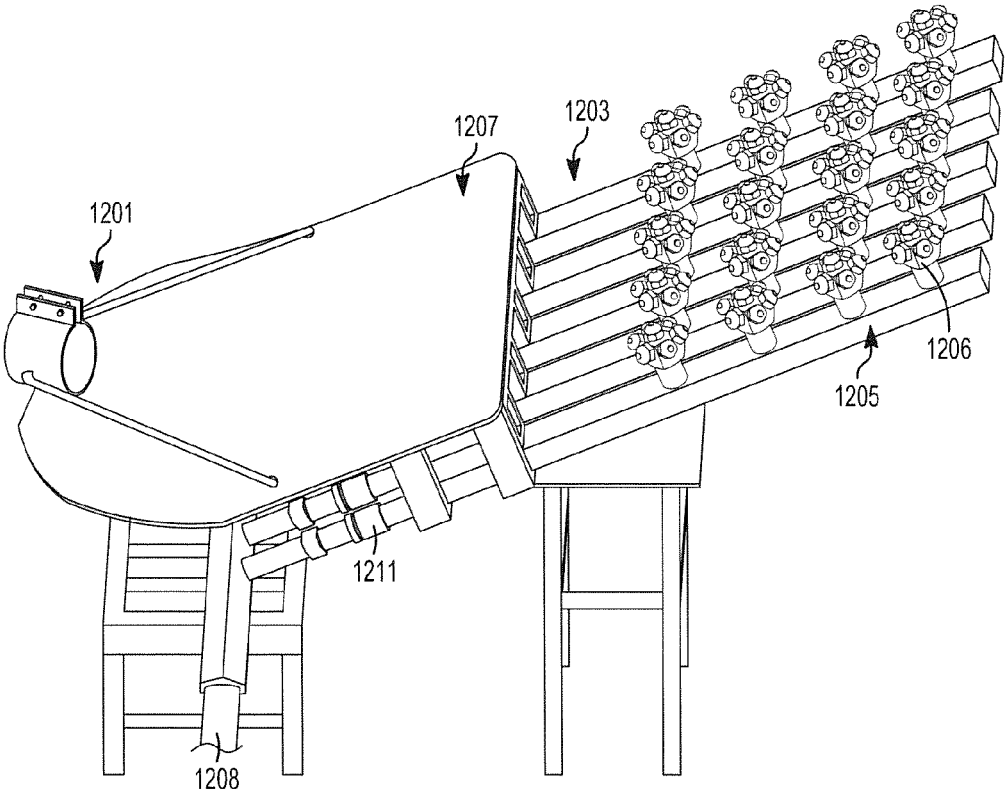
FIG. 23 shows a snow-making machine.

FIG. 23 shows the deflector plate 1207 at the front of the snow making machine 1201 with the nozzle plate 1203 also shown at the front of the machine 1201. Each nozzle plate 1203 has a plurality of water manifolds 1205; which in turn can have up to 10 nozzles 1206; and up to eight water manifolds 1205 can be provided adjacent the deflector plate 1207. The water is introduced by a pump (not shown) or water supply connected to the water supply fitting 1208. The water spray will be connected to an electric heater to ensure the nozzles 1206 do not freeze and become blocked in cold weather.

Figure 24:
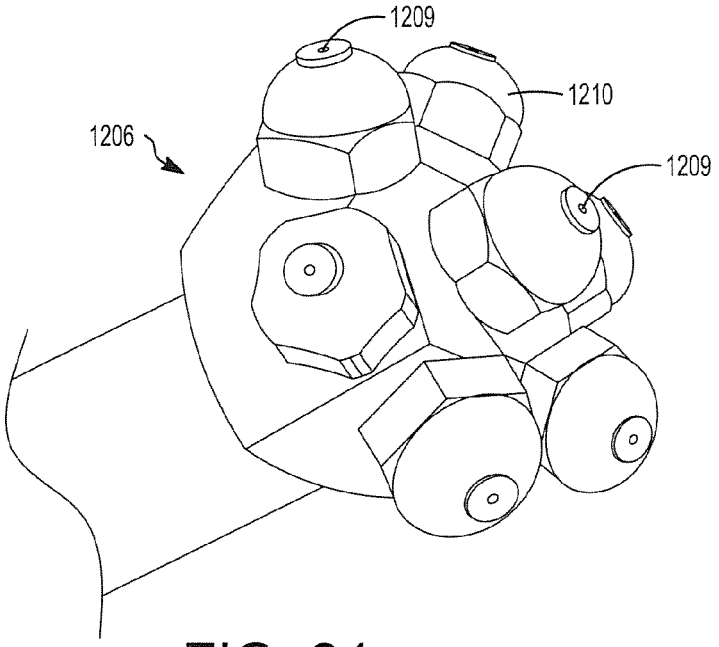
FIG. 24 illustrates a nozzle.

FIG. 24 shows the nozzles 1206 used for the machine which can be supplied in 1 to 20 liter per minute flow rates. Each nozzle 1206 has seven spray nozzles 1209. Each spray nozzle 1209 has a body 1210 on the nozzle 1206, operably connected to the corresponding water manifold 1205. The flow of water to the respective spray nozzles 1209 is controlled by the respective solenoid valve 1211 provided for each water manifold—see FIG. 23. As the high pressure water spray is released from the spray nozzles 1209, the water droplets produced collide and create smaller water droplets. The nozzles 1206 can be provided in brass or stainless steel; and other nozzles with similar characteristics can be used.

Figure 25:
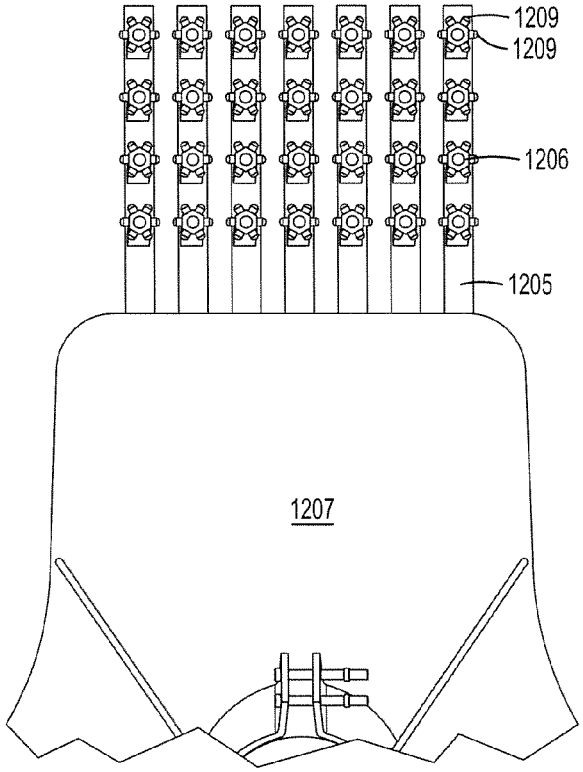
FIG. 25 illustrates spray nozzles and a deflector plate.
Figure 26:
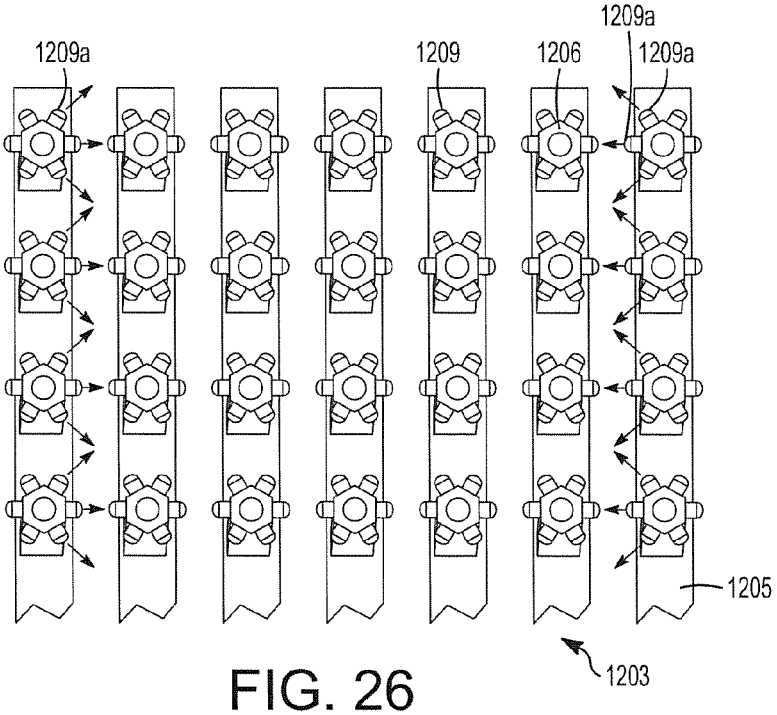
FIG. 26 illustrates a spray nozzle on a nozzle plate.

FIG. 25 shows how the spray nozzles spray 1209 upwardly and the water droplets can mix violently with the snow or cold air that is passing over the top of the nozzles as they leave the defector plate 1207; and FIG. 26 shows the side spray nozzles 1209*a* on either side of the nozzle plate 1203 that spray inwardly at a great force to ensure that the fog of water particles is contained within the area where the water droplets will mix with the air and snow that is blowing through the fog.

Figure 27:
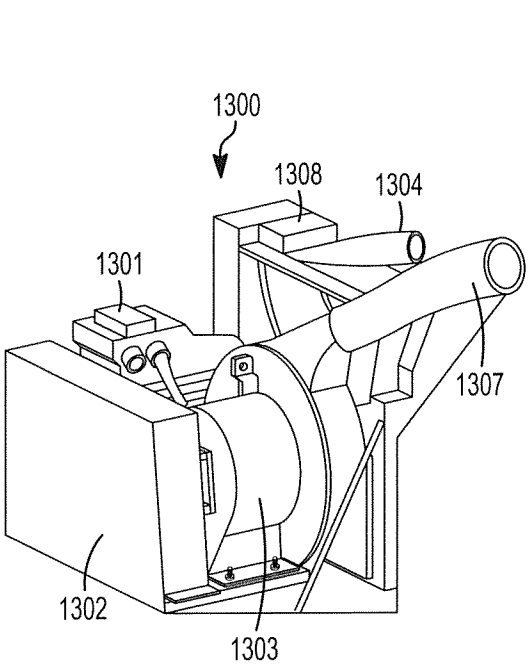
FIG. 27 illustrates a basic external configuration of an embodiment of a snow making apparatus.

FIG. 27 illustrates the basic external configuration of a typical embodiment of the snow making apparatus 1300. The motor 1301 is connected through belts and pulleys 1302 to an impeller fan 1303. The air and recycled snow or ice is introduced through the delivery hopper 1304 that is connected to the snow/ice feed auger 1305. The feed auger 1306 and the delivery hopper 1304 has a quick-release connection to the first inlet of the impeller 1303, to provide a single snow feed unit 1306. The manufactured snow or air only is blown through outlet 1307 into the deflector plate and nozzles (not shown) and the electric control box 1308 controls all the function of the apparatus including the solenoid valves that control the correct amount of water to be added to the snow mix which is calculated from snow production within the impeller and the ambient air temperature at the time. The greater the rate of snow production, and the lower the ambient air temperature, the more water that can be introduced into the stream of snow-like particles.

Figure 28:
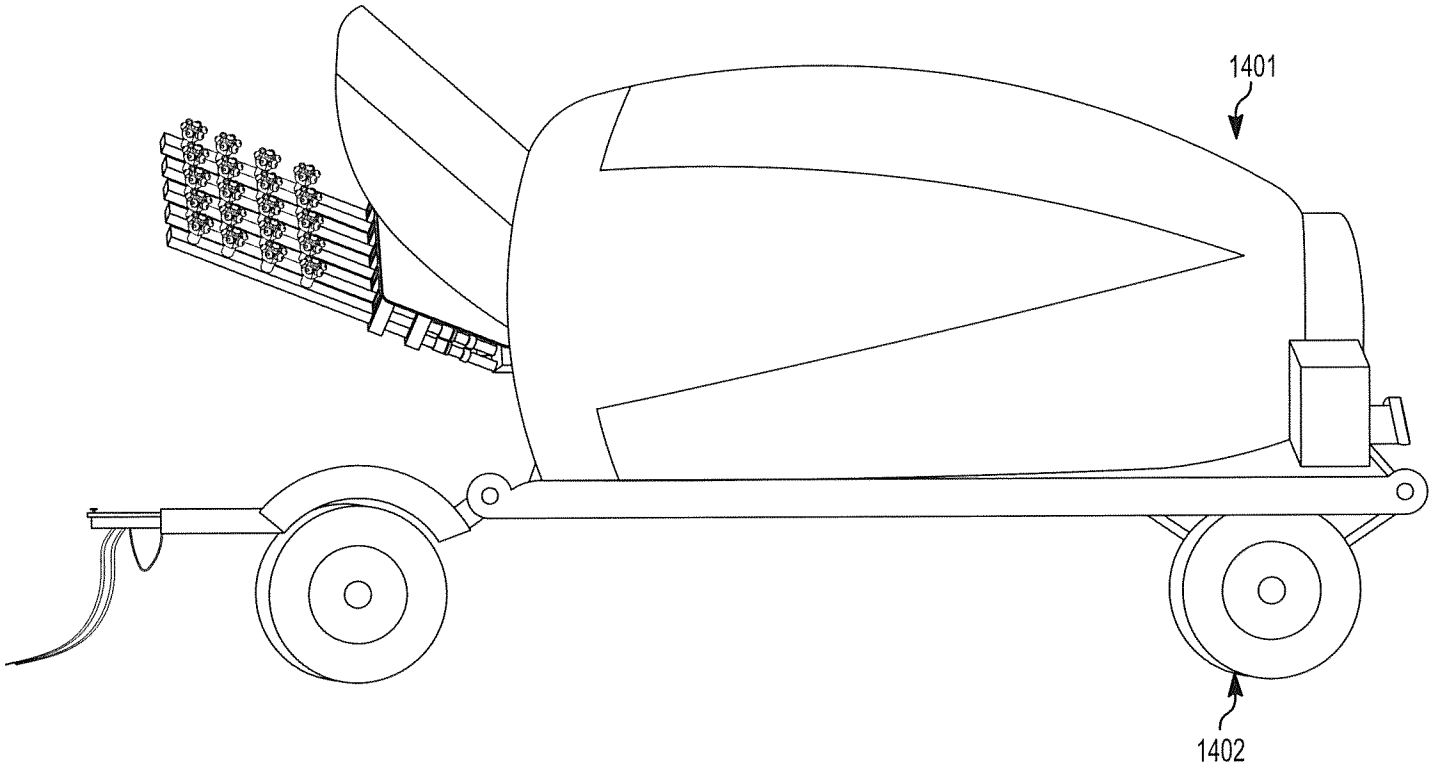
FIG. 28 shows a further embodiment of a snow-making apparatus.

FIG. 28 shows external views of a further embodiment of apparatus 1401 in accordance with the present invention, and the skilled addressee will note that it is relatively compact for the high volume of snow it is capable of efficiently producing.

In FIG. 28, it will be noted that the apparatus 1401 is mounted on a wheeled-trolley or trailer 1402 for ease of transport from site to site.

Figure 29:
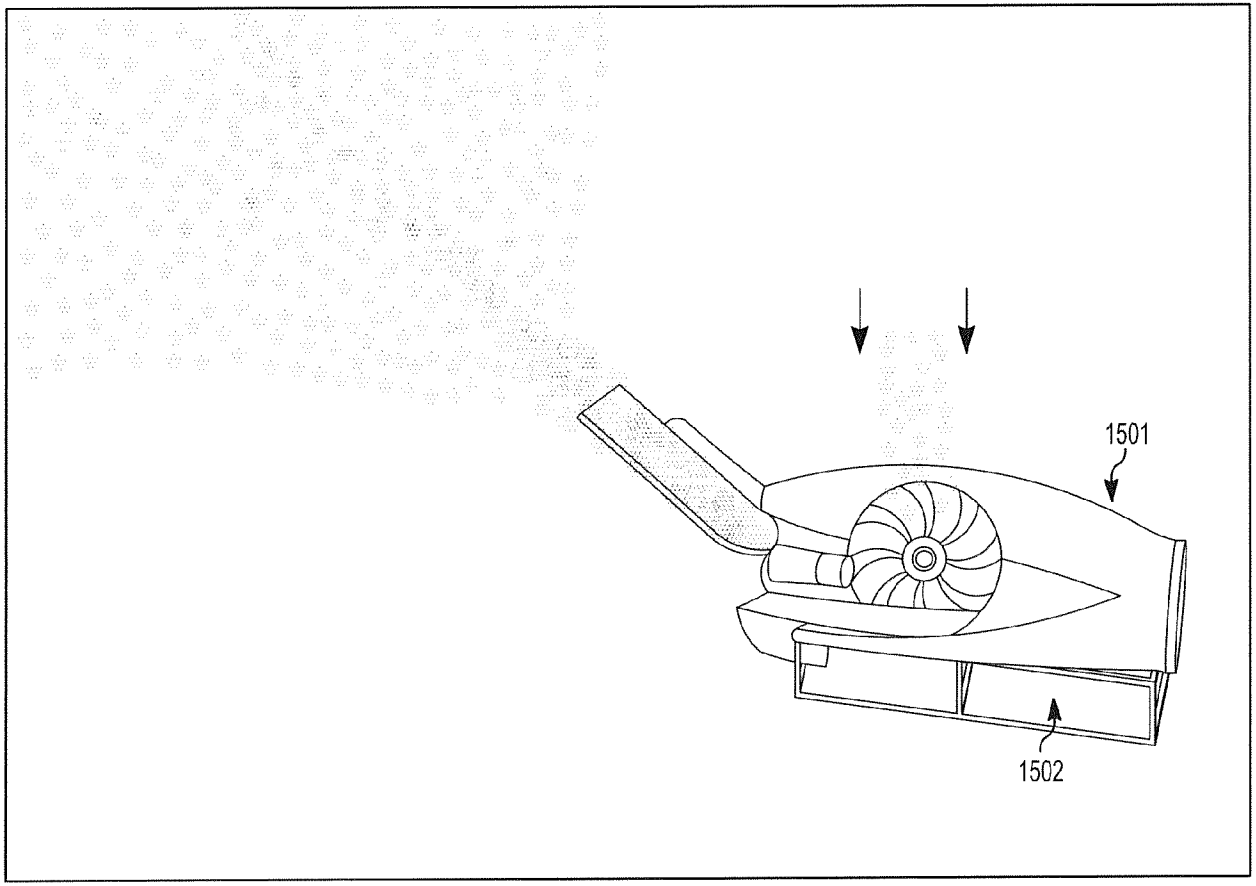
FIG. 29 is a part-sectional schematic illustration of a further embodiment of a snow making machine mounted on skids or skis for transport.

FIG. 29 is a part-sectional schematic illustration of a still further embodiment of the present invention, where the snow making machine 1501 is mounted on skids or skis 1502 for transport. The skilled addressee will appreciate that the operation of the apparatus will be as hereinbefore described.

Figure 30:
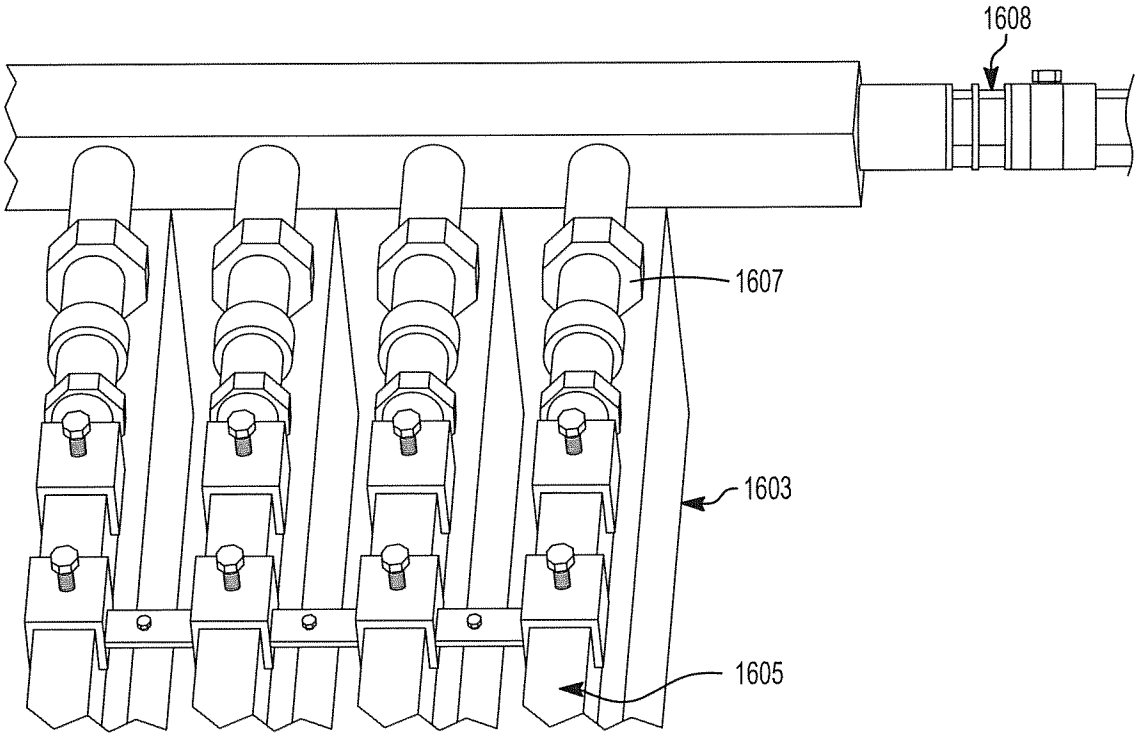
FIG. 30 is an underside view illustrating the solenoid valves connecting water flow to water manifolds of a nozzle plate from a water supply.
Figure 31:
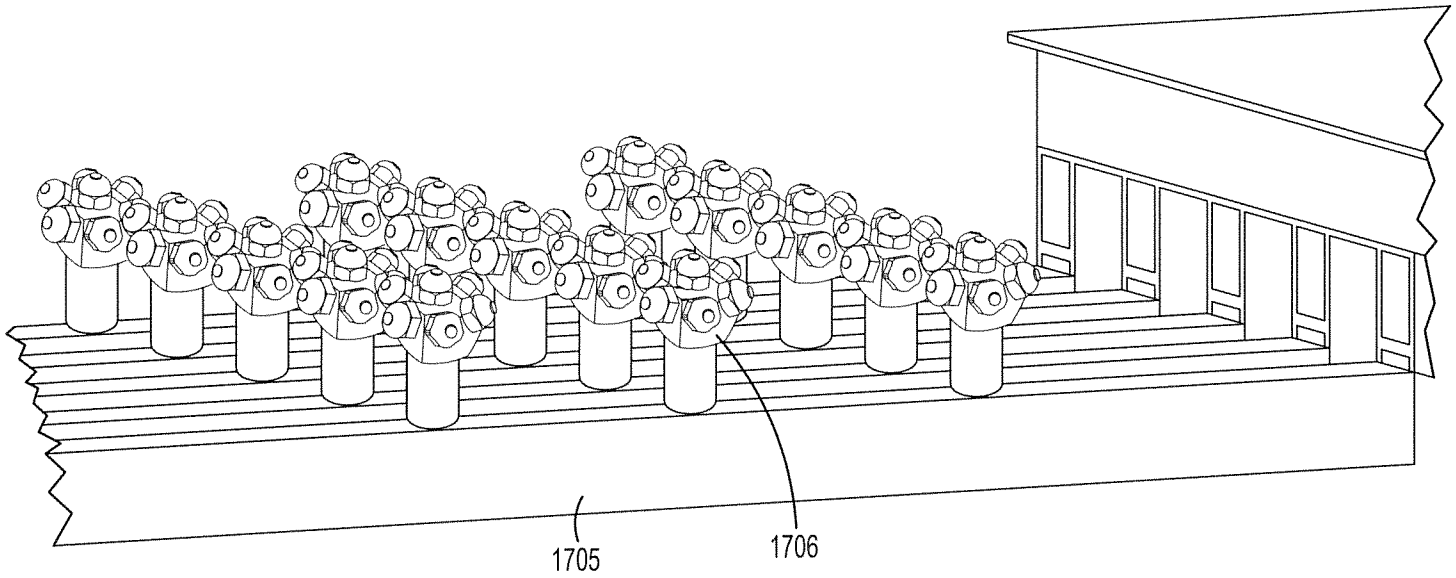
FIG. 31 illustrates nozzles arranged in columns and rows along water manifolds.

FIG. 30 is an underside view illustrating the solenoid valves 1601 connecting water flow to the water manifolds 1605 of the nozzle plate 1603 from water supply 1608; while FIG. 31 illustrates the nozzles 1706 arranged in columns and rows along the water manifolds 1705. By controlling the water flow through the nozzles 1706, the rate at which the water droplets are introduced into the stream of snow-like particles can be accurately controlled for maximum snow production e.g. under the ambient air temperature/air humidity/wind speed conditions currently being experienced.

Figure 32:
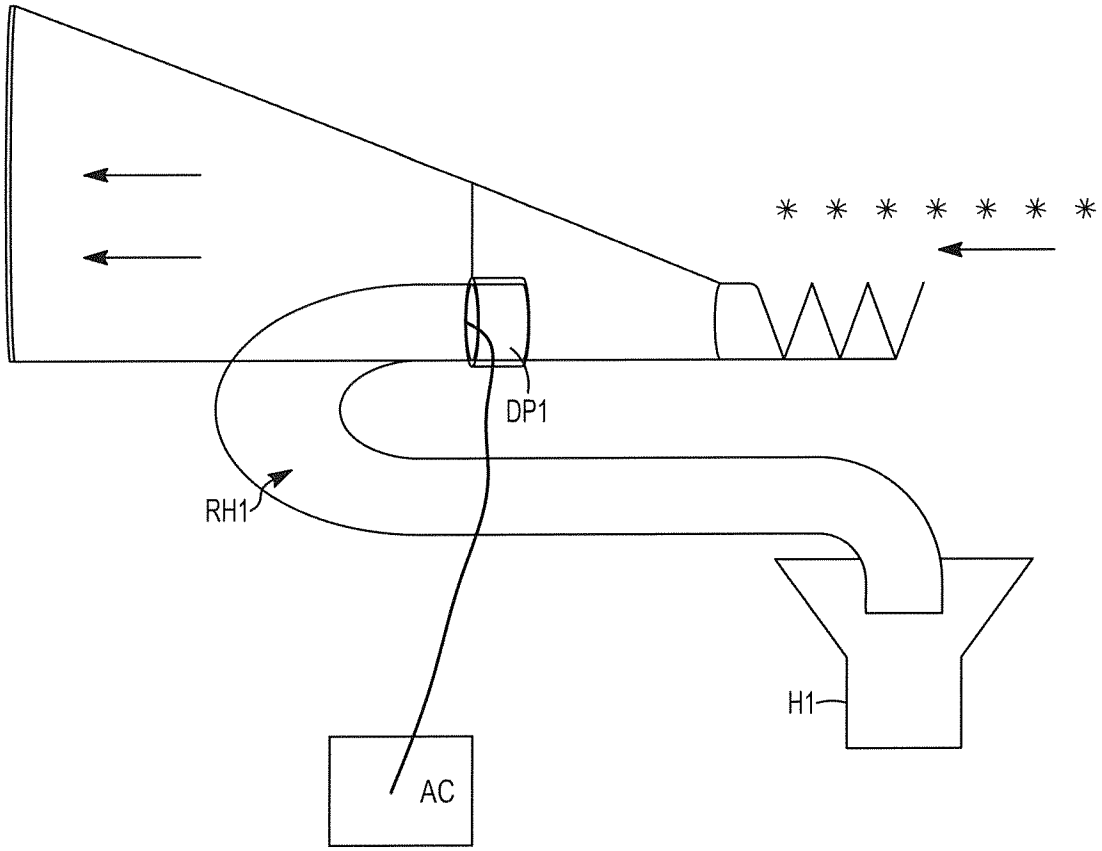
FIG. 32 illustrates a transfer of collected snow back to a snow-making machine by a transfer arrangement.
Figure 33:
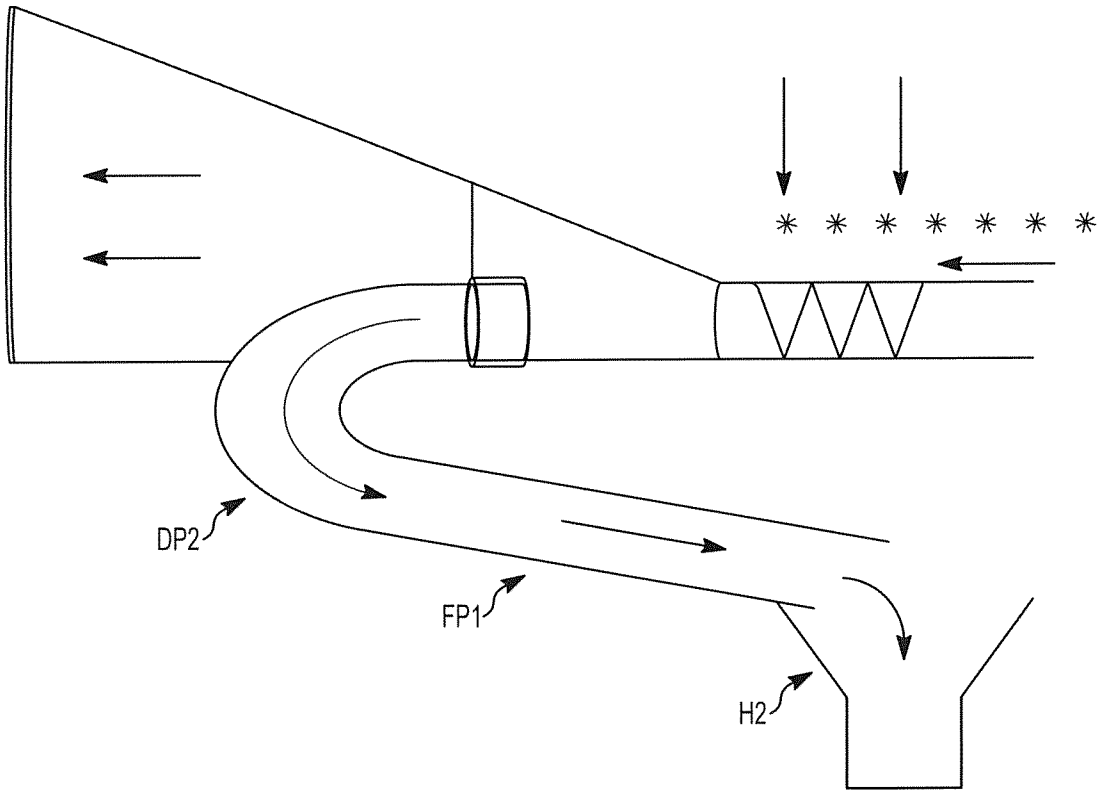
FIG. 33 illustrates a transfer of collected snow back to a snow-making machine by a transfer arrangement.
Figure 34:
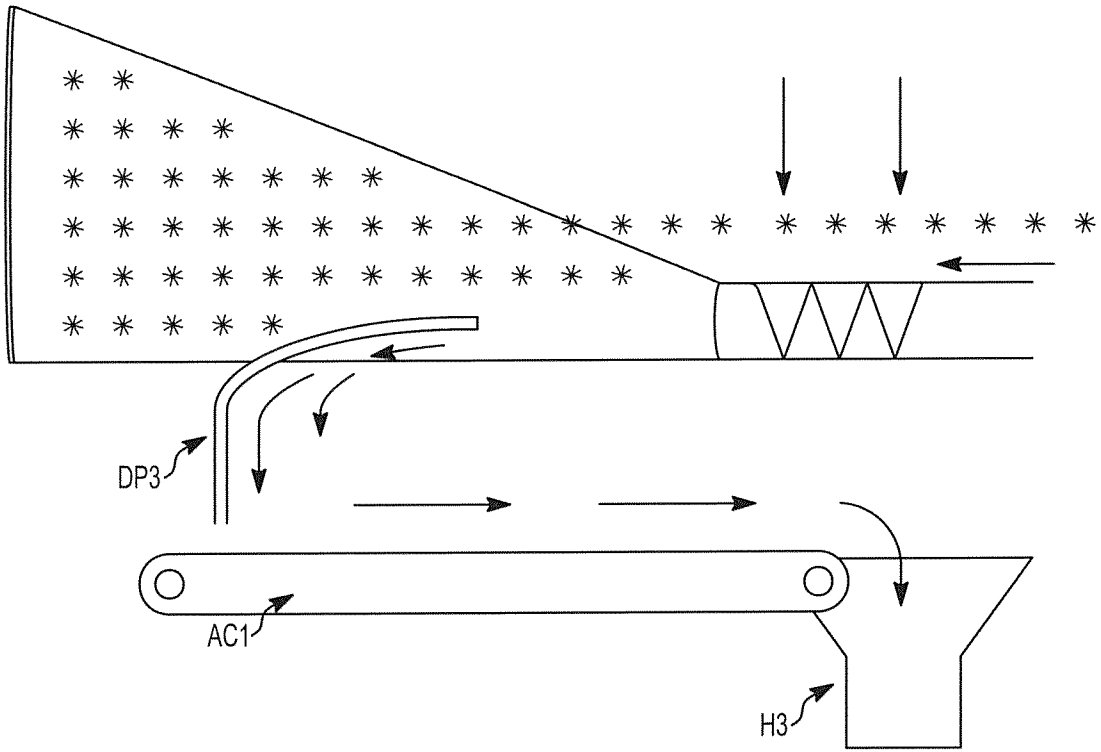
FIG. 34 illustrates a transfer of collected snow back to a snow-making machine by a transfer arrangement.

In certain applications, it will not be possible, or economic, to provide materials-handling equipment e.g. skid-steer loaders to transfer the some/all of produced snow back to the snowmaking machine for the "recycling" process to produce additional snow. FIGS. 32 to 34 schematically illustrate alternative arrangements, whereat least a portion of the produced snow from the snow stream is engaged by a deflector plate or deflector mouth (DP1; DP2; DP3) and is conveyed back to the snow making machine via a recycling hose (RH 1); feed plate (FP 1); or mechanical (i.e. continuous-belt) conveyor (MC1); to a hopper (H1; H2; H3) connected to the inlet to the snow making machine.

Figure 35:
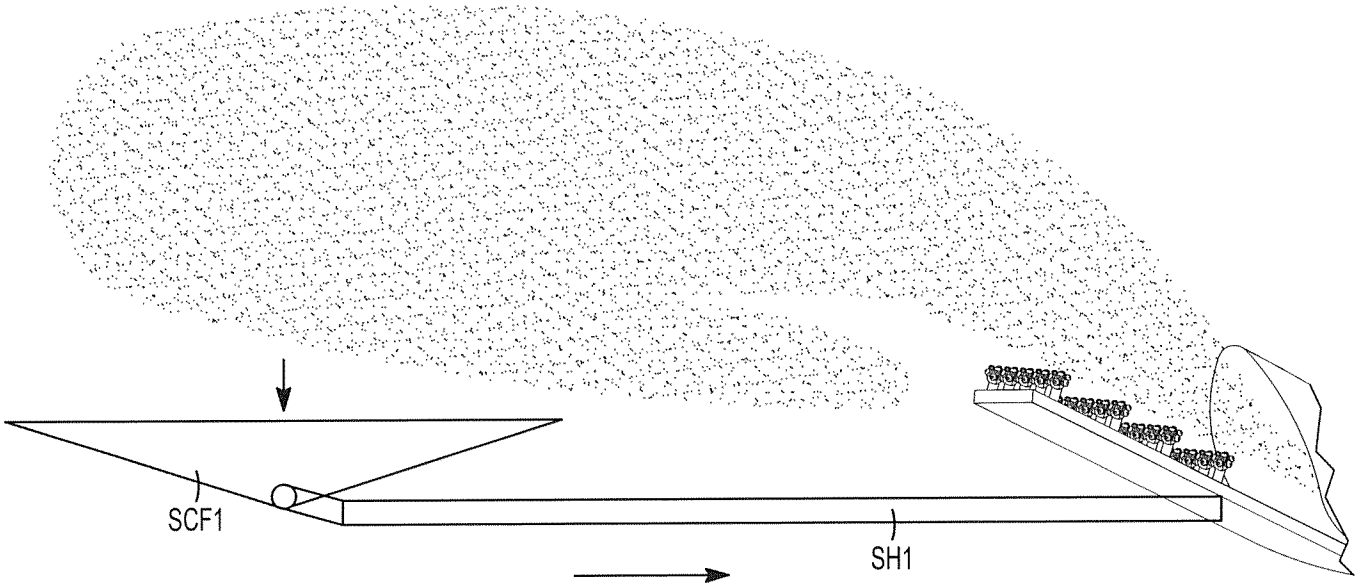
FIG. 35 illustrates a snow catching funnel collecting snow.

Alternatively, as schematically illustrated in FIG. 35, a snow catching-funnel (or hopper) (SCF1) may be located at, or within, the location where the produced snow falls to ground, and the collected snow is transferred back to the snow making machine by any of the transfer arrangements hereinbefore described with reference to FIGS. 32 to 34.

Figure 37:
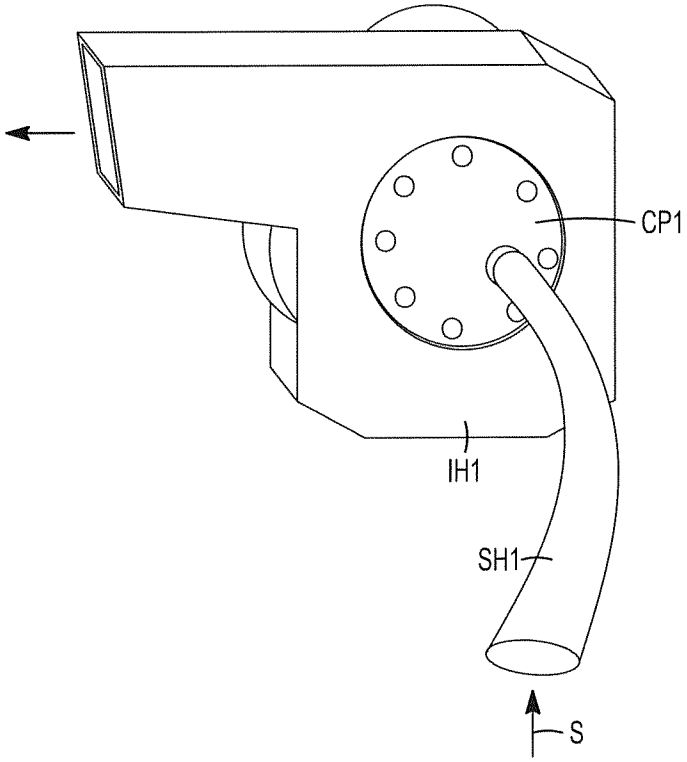
FIG. 37 illustrates in a suction hose which has a cover plate sealably connected to a housing.
Figure 36:
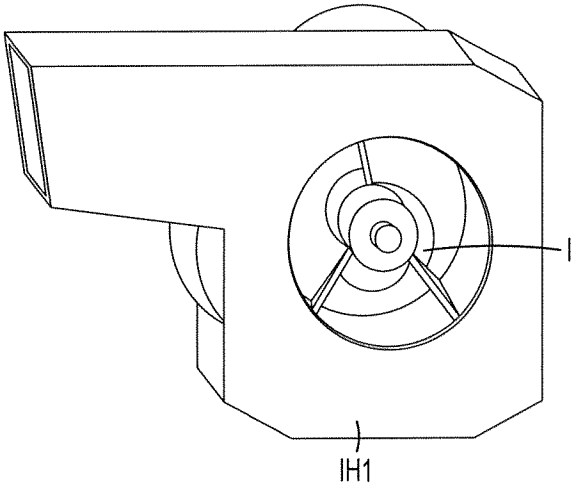
FIG. 36 illustrates an impeller within a housing.

As schematically illustrated in FIGS. 36 and 37, the snow is more preferably transferred from the snow catching funnel (SCF1) to the snow making machine via a suction hose (SH1) which has a cover plate (CP1) sealably connected to the housing (IH1) for the impeller (i); where the impeller (i) creates a partial-vacuum within the suction hose (SH1) to draw the snow into the housing (IH1). In this embodiment, the impeller (I) operates to both smash the ice/recycled snow into new snow particles to which the water is added to produce new snow; but also provides the suction required to transport the snow being recycled back to the snow making machine along the suction hose (SH).

All these embodiments are directed to minimise the equipment requirements to return at least a portion of the snow produced back to the snow making machine; while improving the capital & operating costs for producing the snow.

In certain applications, it may be preferred that the produced snow is directed to a conveyor apparatus e.g. an auger or belt-conveyor which can transport the produced snow to a location on a ski slope which may be difficult to otherwise access.

Figure 38:
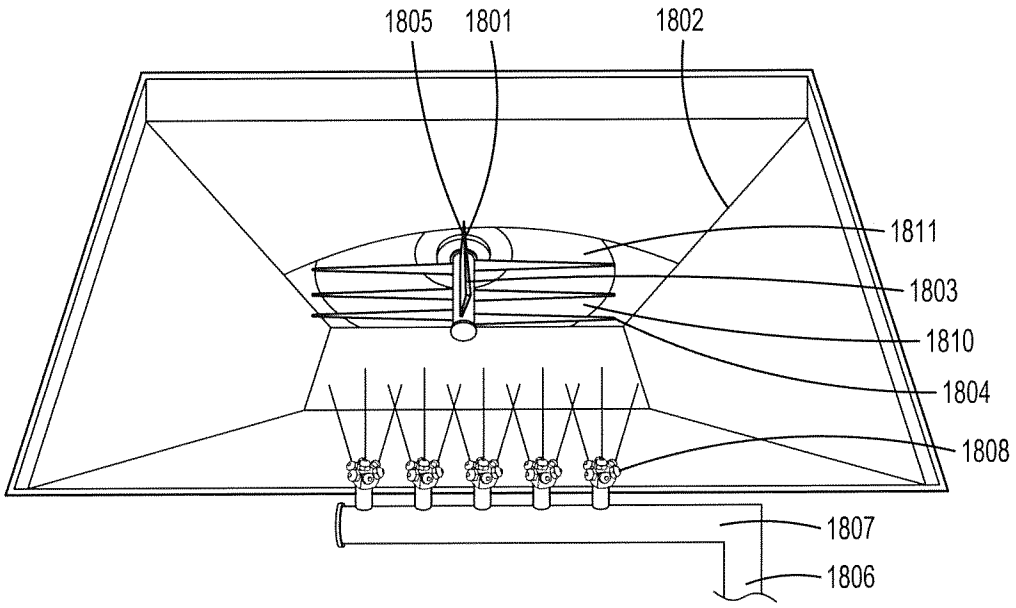
FIG. 38 illustrates a delivery hopper system.

Referring to FIG. 38, experimental trials have established that when the snow or ice in the delivery hopper 1802, connected to the first inlet to the snow making machine, is clumpy or wet, there is the possibility that the throat 1810 of the delivery hopper 1802 can become blocked and stop the snow or ice from passing through the inlet to the impeller 1811. To overcome this problem, the impeller shaft 1801 can be extended into the delivery hopper 1802, and cutting blades 1803 extend from the impeller shaft 1801 to chop up any snow or ice that would otherwise block the flow to the impeller 1811.

In addition, the impeller shaft 1801 may be provided with a secondary blade 1805, extending along, but extending substantially radially from the impeller shaft 1801, to throw off any snow or ice which may otherwise remain on the impeller shaft 1801. The blades 1803, 1805 are preferably manufactured from stainless steel, titanium, or composite plastics, i.e. the same material(s) of the blades of the impeller 1811 (and rotate simultaneously therewith).

In a further modified embodiment, water nozzles 1808 may be provided at the mouth of the delivery hopper 1804, to direct fine water droplets to the snow or ice in the delivery hopper 1802. These water droplets are multiplied into new snow with the snow or ice entering the snow making machine from the delivery hopper 1802.

The water nozzles 1808 are connected to a water manifold 1807, in turn connected to a water supply 1806. This arrangement can also be used for cleaning the interior of the snow making machine, where the water supply 1806 may be connected to either hot or cold water.

Figure 39:
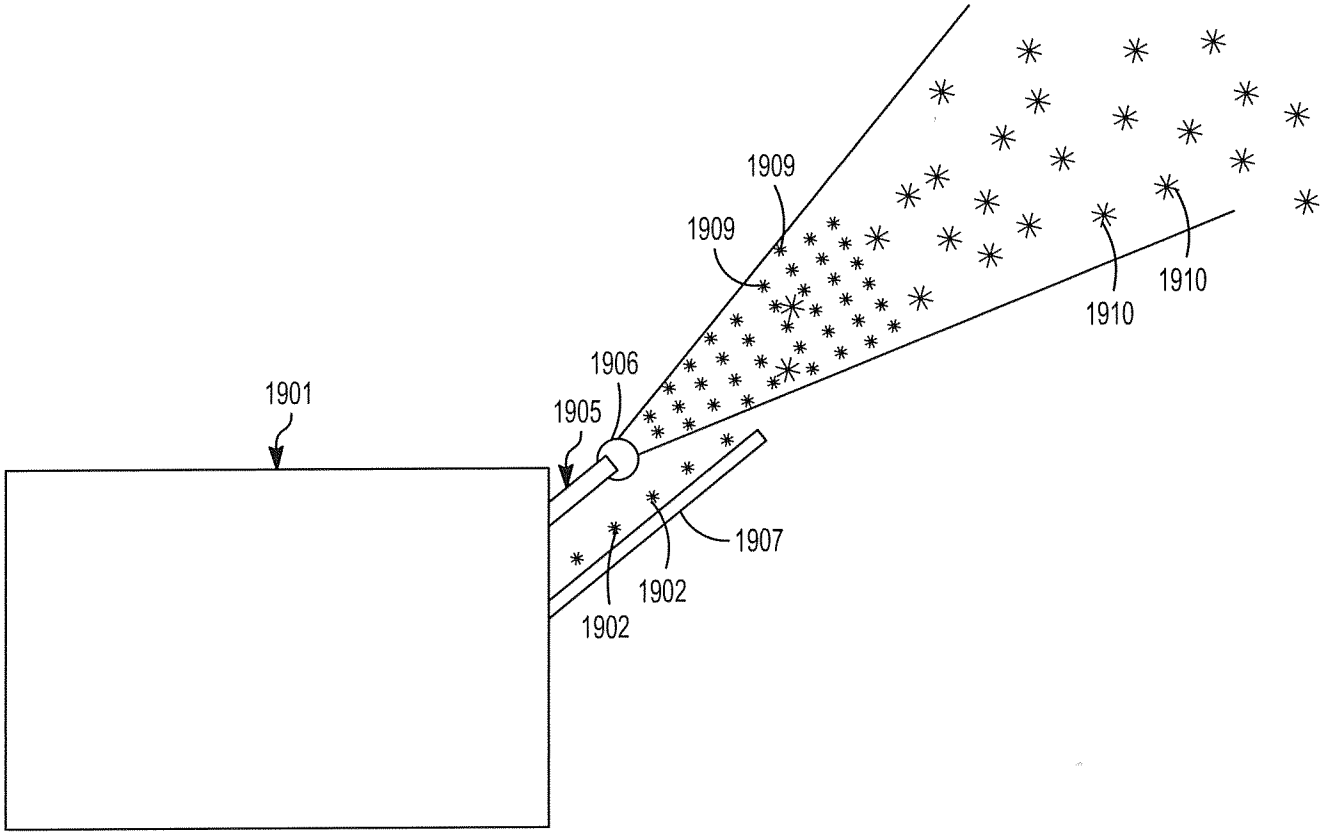
FIG. 39 illustrates a further embodiment of a snow-making machine.

FIG. 39 illustrates a still further preferred embodiment of the present invention, where the water can be directed e.g. 50 m-100 m into the air to achieve maximum "hang-time" for the production of the snow. The snow making machine 1901 discharges the snow particles 1902, generated by the impeller, over the deflector plate 1907 at the highest velocity possible. A water jet 1905, with a water nozzle 1906, is mounted above the deflector plate 1907, and which may be operable to be reciprocated transversely in a substantially horizontal plane. (The water jet 1905 may also be mounted for adjustable elevation in the vertical plane) The water droplets 1909 from the water nozzle 1906 impact the snow particles 1902; are mixed therewith; and form new snow 1910, as hereinbefore described. By connecting the water jet to a high pressure source of water, the water can be directed e.g. 50 m-100 m into the below freezing ambient air to achieve maximum "hang-time", and thereby mixing time, between the water droplets 1909 and the snow particles 1902 to produce the maximum quantity of snow 1910.

An example of existing water jets suitable for modification for use with the present invention are the reciprocating high-pressure water jet used to on large-area agricultural/horticultural sprinklers.

The embodiments described and illustrated enable snow to be produced under a wade range of conditions; for a wide range of potential applications.

From the above description, it will be readily obvious to those skilled in the art, that many variations or modifications can be made to the embodiments hereinbefore described, without deviating from the present invention.

The invention claimed is:

1. A method for making snow, including the steps of:

a) forming particles from ice;

b) blowing at least one stream of the particles into ambient air, the ambient air having a temperature just above, or below, the freezing point of water;

c) directing a spray or mist of water droplets into the stream to form snow flakes; and d) vacuuming and adding at least a portion of the snow flakes to particles before step b), after at least one iteration of steps a)-c).

2. The method claim 1, wherein:

the particles act as nucleating agents for the water droplets to assist in the formation of the snow flakes.

3. The method of claim 1, wherein the snow flakes are vacuumed into a chamber of a snow-making machine by an impeller located in the chamber.

4. The method of claim 1, wherein:

in step d), all of the snow flakes are added to the particles until the desired quantity of snow has been produced.

5. The method of claim 1, wherein:

in step a), the particles are formed from block- or chipped-ice in a snow-making machine.

6. The method of claim 1, wherein existing snow is added to the stream of particles to provide further nucleating agents for the water droplets.

7. The method of claim 1, wherein:

frozen ice from lakes, waterways, storage containers or other local sources, or ice produced by an ice-making machine is added to the stream of particles.

* * * * *